US007510026B2

(12) United States Patent
Pastusek et al.

(10) Patent No.: US 7,510,026 B2
(45) Date of Patent: Mar. 31, 2009

(54) METHOD AND APPARATUS FOR COLLECTING DRILL BIT PERFORMANCE DATA

(75) Inventors: Paul E. Pastusek, The Woodlands, TX (US); Eric C. Sullivan, Houston, TX (US); Daryl L. Pritchard, Shenandoah, TX (US); Keith Glasgow, Willis, TX (US); Tu Tien Trinh, Houston, TX (US); Paul J. Lutes, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/939,389

(22) Filed: Nov. 13, 2007

(65) Prior Publication Data

US 2008/0060848 A1 Mar. 13, 2008

Related U.S. Application Data

(62) Division of application No. 11/146,934, filed on Jun. 7, 2005.

(51) Int. Cl.
*E21B 47/00* (2006.01)

(52) U.S. Cl. ..... 175/40; 73/152.45

(58) Field of Classification Search ..... 175/45, 175/40, 501; 73/152.48, 152.59; 173/327
See application file for complete search history.

(56) References Cited

U.S. PATENT DOCUMENTS 2,507,351 A 5/1950 Scherbatskoy
4,884,071 A 11/1989 Howard
4,958,517 A 9/1990 Maron
5,012,412 A 4/1991 Helm
5,129,471 A 7/1992 Maurstad et al.

(Continued)

FOREIGN PATENT DOCUMENTS

GB 2395971 B2 9/2004

OTHER PUBLICATIONS

Carcione, Jose M., et al., "A Telegrapher Equation for Electric Telemetering in Drill Strings," IEEE Transactions on Geoscience and Remote Sensing, vol. 40, No. 5, May 2002, pp. 1047-1053.

(Continued)

*Primary Examiner*—David J Bagnell
*Assistant Examiner*—Daniel P Stephenson
(74) *Attorney, Agent, or Firm*—TraskBritt

(57) ABSTRACT

Drill bits and methods for sampling sensor data associated with the state of a drill bit are disclosed. A drill bit for drilling a subterranean formation comprises a bit body and a shank. The shank further includes a central bore formed through an inside diameter of the shank and configured for receiving a data analysis module. The data analysis module comprises a plurality of sensors, a memory, and a processor. The processor is configured for executing computer instructions to collect the sensor data by sampling the plurality of sensors, analyzing the sensor data to develop a severity index, comparing the sensor data to at least one adaptive threshold, and modifying a data sampling mode responsive to the comparison. A method comprises collecting sensor data by sampling a plurality of physical parameters associated with a drill bit state while in various sampling modes and transitioning between those sampling modes.

20 Claims, 18 Drawing Sheets

U.S. PATENT DOCUMENTS

| | | | |
|---|---|---|---|
| 5,160,925 | A | 11/1992 | Dailey et al. |
| 5,415,030 | A | 5/1995 | Jogi et al. |
| 5,493,288 | A | 2/1996 | Henneuse |
| 5,553,678 | A | 9/1996 | Barr et al. |
| 5,720,355 | A | 2/1998 | Lamine et al. |
| 5,813,480 | A | 9/1998 | Zaleski, Jr. et al. |
| 5,842,149 | A | 11/1998 | Harrell et al. |
| 5,864,058 | A | 1/1999 | Chen |
| 6,021,377 | A | 2/2000 | Dubinsky et al. |
| 6,057,784 | A | 5/2000 | Schaaf et al. |
| 6,176,323 | B1 | 1/2001 | Weirich et al. |
| 6,206,108 | B1 | 3/2001 | MacDonald et al. |
| 6,230,822 | B1 | 5/2001 | Sullivan et al. |
| 6,233,524 | B1 | 5/2001 | Harrell et al. |
| 6,419,032 | B1 | 7/2002 | Sullivan et al. |
| 6,427,783 | B2 | 8/2002 | Krueger et al. |
| 6,540,033 | B1 | 4/2003 | Sullivan et al. |
| 6,543,312 | B2 | 4/2003 | Sullivan et al. |
| 6,571,886 | B1 | 6/2003 | Sullivan et al. |
| 6,626,251 | B1 | 9/2003 | Sullivan et al. |
| 6,648,082 | B2 | 11/2003 | Schultz et al. |
| 6,651,496 | B2 | 11/2003 | Van Steenwyk et al. |
| 6,668,465 | B2 | 12/2003 | Noureldin et al. |
| 6,672,409 | B1 | 1/2004 | Dock et al. |
| 6,681,633 | B2 | 1/2004 | Schultz et al. |
| 6,691,802 | B2 | 2/2004 | Schultz et al. |
| 6,691,804 | B2 | 2/2004 | Harrison |
| 6,698,536 | B2 | 3/2004 | Moran et al. |
| 6,712,160 | B1 | 3/2004 | Schultz et al. |
| 6,722,450 | B2 | 4/2004 | Schultz et al. |
| 6,742,604 | B2 | 6/2004 | Brazil et al. |
| 6,769,497 | B2 | 8/2004 | Dubinsky et al. |
| 6,816,788 | B2 | 11/2004 | Van Steenwyk et al. |
| 6,817,425 | B2 | 11/2004 | Schultz et al. |
| 6,820,702 | B2 | 11/2004 | Niedermayr et al. |
| 6,837,314 | B2 | 1/2005 | Krueger et al. |
| 6,892,812 | B2 | 5/2005 | Niedermayr et al. |
| 6,896,055 | B2 | 5/2005 | Koithan |
| 7,017,662 | B2 | 3/2006 | Schultz et al. |
| 7,066,280 | B2 | 6/2006 | Sullivan et al. |
| 7,080,460 | B2 | 7/2006 | Illfelder |
| 7,143,521 | B2 | 12/2006 | Haugland |
| 7,260,477 | B2 | 8/2007 | Haugland |
| 2003/0130846 | A1 | 7/2003 | King |
| 2004/0050590 | A1 | 3/2004 | Pirovolou et al. |
| 2004/0112640 | A1 | 6/2004 | Hay et al. |
| 2004/0124012 | A1 | 7/2004 | Dunlop et al. |
| 2004/0168827 | A1 | 9/2004 | Jeffryes |
| 2006/0006000 | A1 | 1/2006 | Weston et al. |
| 2006/0260843 | A1 | 11/2006 | Cobern |
| 2007/0017705 | A1 | 1/2007 | Lasater |

OTHER PUBLICATIONS

Dashevskiy, D., et al., "Application of Neural Networks for Predictive Control in Drilling Dynamics," SPE 56442, © 1999, Society of Petroleum Engineers Inc.

Finger, J.T., et al., "Development of a System for Diagnostic-While-Drilling (DWD)," SPE/IADC 79884, SPE/IADC Drilling Conference, Amsterdam, The Netherlands, Feb. 19-21, 2003.

Goswami, Jaideva C., et al., "A Robust Technique for Well-Log Data Inversion," IEEE Transactions on Antennas and Propagation, vol. 52, No. 3, Mar. 2004, pp. 717-724.

Hoefel, Albert, et al., "Subsurface Telemetry in Conductive Medium for Remote Sensors," IEEE, (0-7803-7846-6/03), 2003, pp. 227-230.

Leseultre, A., et al., "An Instrumented Bit: A necessary step to the intelligent BHA," IADC/SPE 39341, © 1998, IADC/SPE Drilling Conference.

Ramamurthi, K., et al., "Real Time Expert System for Predictive Diagnostics and Control of Drilling Operation," IEEE (CH2842-3/90/0000/0062), 1990, pp. 62-69.

Schultz, Roger L., et al., "Oilwell Drillbit Failure Detection Using Remote Acoustic Sensing," Proceedings of the American Control Conference, Anchorage, AK, May 8-10, 2002, pp. 2603-2608.

Sinanovic, Sinan, et al., "Data Communication Along the Drill String Using Acoustic Waves," IEEE (0-7803-8484-9/04), 2004, pp. IV-909 through IV-912.

Trofimenkoff, F.N., et al., "Characterization of EM Downhole-to-Surface Communication Links," IEEE Transactions on Geoscience and Remote Sensing, vol. 38, No. 6, Nov. 2000, pp. 2539-2548.

International Search Report for International Counterpart Application No. PCT/US2006/022029, dated Oct. 25, 2006 (5 pages).

METHOD AND APPARATUS FOR COLLECTING DRILL BIT PERFORMANCE DATA

CROSS-REFERENCE TO RELATED APPLICATION

This application is a divisional of application Ser. No. 11/146,934, filed Jun. 7, 2005, pending. The disclosure of the previously referenced U.S. patent applications and patents (if applicable) referenced is hereby incorporated by reference in its entirety.

BACKGROUND OF THE INVENTION

1. Field of the Invention

The present invention relates generally to drill bits for drilling subterranean formations and more particularly to methods and apparatuses for monitoring operating parameters of drill bits during drilling operations.

2. State of the Art

The oil and gas industry expends sizable sums to design cutting tools, such as downhole drill bits including roller cone rock bits and fixed cutter bits, which have relatively long service lives, with relatively infrequent failure. In particular considerable sums are expended to design and manufacture roller cone rock bits and fixed cutter bits in a manner that minimizes the opportunity for catastrophic drill bit failure during drilling operations. The loss of a roller cone or a polycrystalline diamond compact (PDC) from a fixed cutter bit during drilling operations can impede the drilling operations and, at worst, necessitate rather expensive fishing operations. If the fishing operations fail, sidetrack-drilling operations must be performed in order to drill around the portion of the wellbore that includes the lost roller cones or PDC cutters. Typically, during drilling operations, bits are pulled and replaced with new bits even though significant service could be obtained from the replaced bit. These premature replacements of downhole drill bits are expensive, since each trip out of the well prolongs the overall drilling activity, and consumes considerable manpower, but are nevertheless done in order to avoid the far more disruptive and expensive process of, at best, pulling the drillstring and replacing the bit or fishing and sidetrack drilling operations necessary if one or more cones or compacts are lost due to bit failure.

With the ever-increasing need for downhole drilling system dynamic data, a number of "subs" (i.e., a sub-assembly incorporated into the drillstring above the drill bit and used to collect data relating to drilling parameters) have been designed and installed in drillstrings. Unfortunately, these subs cannot provide actual data for what is happening operationally at the bit due to their physical placement above the bit itself.

Data acquisition is conventionally accomplished by mounting a sub in the Bottom Hole Assembly (BHA), which may be several feet to tens of feet away from the bit. Data gathered from a sub this far away from the bit may not accurately reflect what is happening directly at the bit while drilling occurs. Often, this lack of data leads to conjecture as to what may have caused a bit to fail or why a bit performed so well, with no directly relevant facts or data to correlate to the performance of the bit.

Recently, data acquisition systems have been proposed to install in the drill bit itself. However, data gathering, storing, and reporting from these systems has been limited. In addition, conventional data gathering in drill bits has not had the capability to adapt to drilling events that may be of interest in a manner allowing more detailed data gathering and analysis when these events occur.

There is a need for a drill bit equipped to gather and store long-term data that is related to performance and condition of the drill bit. Such a drill bit may extend useful bit life enabling re-use of a bit in multiple drilling operations and developing drill bit performance data on existing drill bits, which also may be used for developing future improvements to drill bits.

BRIEF SUMMARY OF THE INVENTION

The present invention includes a drill bit and a data analysis system disposed within the drill bit for analysis of data sampled from physical parameters related to drill bit performance using a variety of adaptive data sampling modes.

In one embodiment of the invention, a drill bit for drilling a subterranean formation comprises a bit body, a shank, a data analysis module, and an end-cap. The bit body carries at least one cutting element (also referred to as a blade or a cutter). The shank is secured to the bit body, is adapted for coupling to a drillstring, and includes a central bore formed therethrough. The data analysis module may be configured in an annular ring such that it may be disposed in the central bore while permitting passage of drilling fluid therethrough. Finally, the end-cap is configured for disposition in the central bore such that the end-cap has the annular ring of the data analysis module disposed therearound and provides a chamber for the data analysis module by providing a sealing structure between the end-cap and the wall of the central bore.

Another embodiment of the invention comprises an apparatus for drilling a subterranean formation including a drill bit and a data analysis module disposed in the drill bit. The drill bit carries at least one blade or cutter and is adapted for coupling to a drillstring. The data analysis module comprises at least one sensor, a memory, and a processor. The at least one sensor is configured for sensing at least one physical parameter. The memory is configured for storing information comprising computer instructions and sensor data. The processor is configured for executing the computer instructions to collect the sensor data by sampling the at least one sensor. The computer instructions are further configured to analyze the sensor data to develop a severity index, compare the severity index to at least one adaptive threshold, and modify a data sampling mode responsive to the comparison.

Another embodiment of the invention includes a method comprising collecting sensor data at a sampling frequency by sampling at least one sensor disposed in a drill bit. In this method, the at least one sensor is responsive to at least one physical parameter associated with a drill bit state. The method further comprises analyzing the sensor data to develop a severity index, wherein the analysis is performed by a processor disposed in the drill bit. The method further comprises comparing the severity index to at least one adaptive threshold and modifying a data sampling mode responsive to the comparison.

Another embodiment of the invention includes a method comprising collecting background data by sampling at least one physical parameter associated with a drill bit state at a background sampling frequency while in a background mode. The method further includes transitioning from the background mode to a logging mode after a predetermined number of background samples. The method may also include transitioning from the background mode to a burst mode after a predetermined number of background samples. The method may also include transitioning from the logging mode to the background mode or the burst mode after a predetermined number of logging samples. The method may also include transitioning from the burst mode to the background mode or the logging mode after a predetermined number of burst samples.

Another embodiment of the invention includes a method comprising collecting background data by sampling at least one physical parameter associated with a drill bit state while in a background mode. The method further includes analyzing the background data to develop a background severity index and transitioning from the background mode to a logging mode if the background severity index is greater than a first background threshold. The method may also include transitioning from the background mode to a burst mode if the background severity index is greater than a second background threshold.

DETAILED DESCRIPTION OF THE INVENTION

The present invention includes a drill bit and electronics disposed within the drill bit for analysis of data sampled from physical parameters related to drill bit performance using a variety of adaptive data sampling modes.

Figure 1:
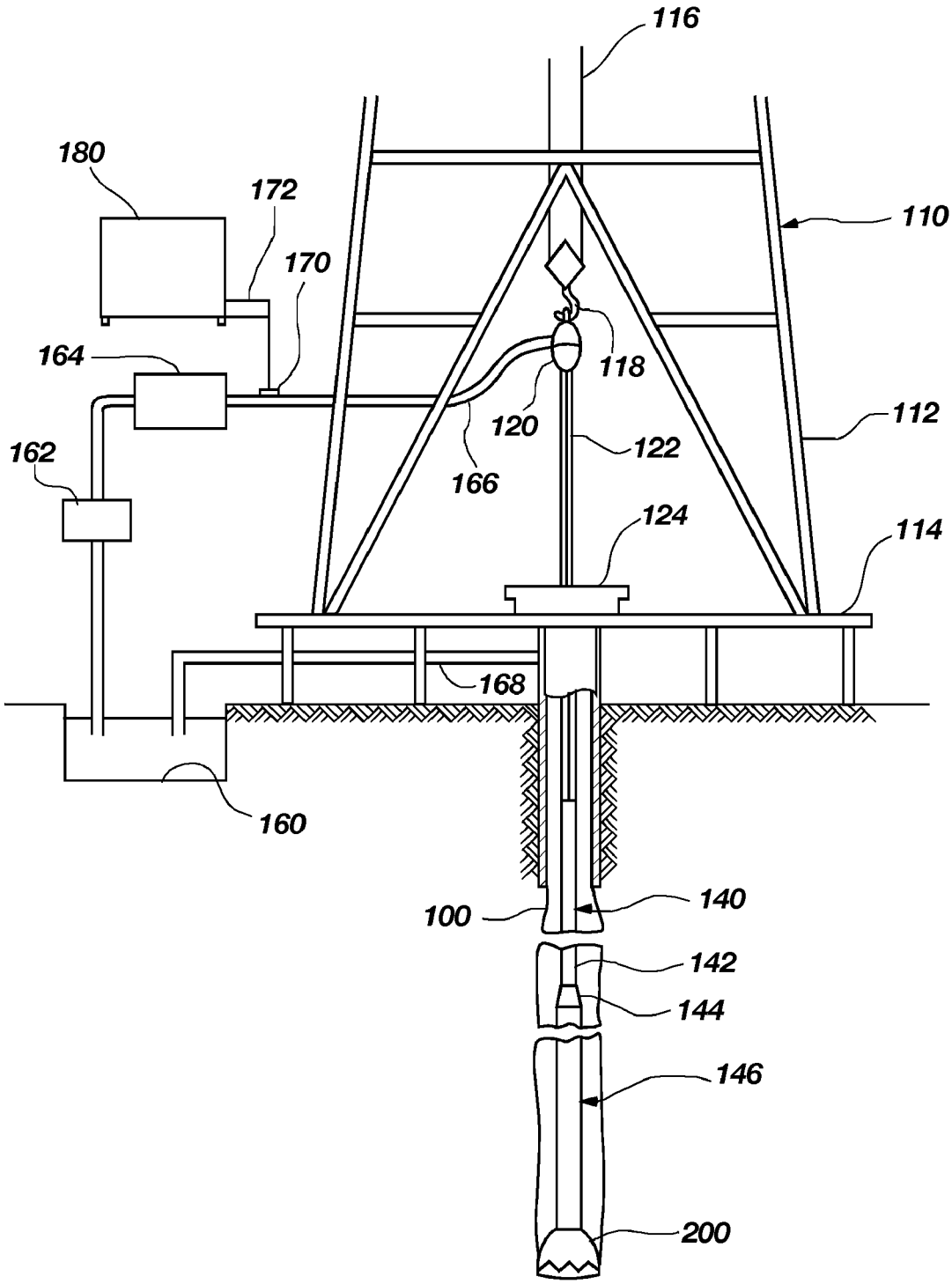
FIG. 1 illustrates a conventional drilling rig for performing drilling operations.

FIG. 1 depicts an exemplary apparatus for performing subterranean drilling operations. An exemplary drilling rig 110 includes a derrick 112, a derrick floor 114, a draw works 116, a hook 118, a swivel 120, a Kelly joint 122, and a rotary table 124. A drillstring 140, which includes a drill pipe section 142 and a drill collar section 144, extends downward from the drilling rig 110 into a borehole 100. The drill pipe section 142 may include a number of tubular drill pipe members or strands connected together and the drill collar section 144 may likewise include a plurality of drill collars. In addition, the drillstring 140 may include a measurement-while-drilling (MWD) logging subassembly and cooperating mud pulse telemetry data transmission subassembly, which are collectively referred to as an MWD communication system 146, as well as other communication systems known to those of ordinary skill in the art.

During drilling operations, drilling fluid is circulated from a mud pit 160 through a mud pump 162, through a desurger 164, and through a mud supply line 166 into the swivel 120. The drilling mud (also referred to as drilling fluid) flows through the Kelly joint 122 and into an axial central bore in the drillstring 140. Eventually, it exits through apertures or nozzles, which are located in a drill bit 200, which is connected to the lowermost portion of the drillstring 140 below drill collar section 144. The drilling mud flows back up through an annular space between the outer surface of the drillstring 140 and the inner surface of the borehole 100, to be circulated to the surface where it is returned to the mud pit 160 through a mud return line 168.

A shaker screen (not shown) may be used to separate formation cuttings from the drilling mud before it returns to the mud pit 160. The MWD communication system 146 may utilize a mud pulse telemetry technique to communicate data from a downhole location to the surface while drilling operations take place. To receive data at the surface, a mud pulse transducer 170 is provided in communication with the mud supply line 166. This mud pulse transducer 170 generates electrical signals in response to pressure variations of the drilling mud in the mud supply line 166. These electrical signals are transmitted by a surface conductor 172 to a surface electronic processing system 180, which is conventionally a data processing system with a central processing unit for executing program instructions, and for responding to user commands entered through either a keyboard or a graphical pointing device. The mud pulse telemetry system is provided for communicating data to the surface concerning numerous downhole conditions sensed by well logging and measurement systems that are conventionally located within the MWD communication system 146. Mud pulses that define the data propagated to the surface are produced by equipment conventionally located within the MWD communication system 146. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by the mud pulse transducer 170. An alternative conventional arrangement generates and transmits positive pressure pulses. As is conventional, the circulating drilling mud also may provide a source of energy for a turbine-driven generator subassembly (not shown) which may be located near a bottom hole assembly (BHA). The turbine-driven generator may generate electrical power for the pressure pulse generator and for various circuits including those circuits that form the operational components of the measurement-while-drilling tools. As an alternative or supplemental source of electrical power, batteries may be provided, particularly as a back up for the turbine-driven generator.

Figure 2:
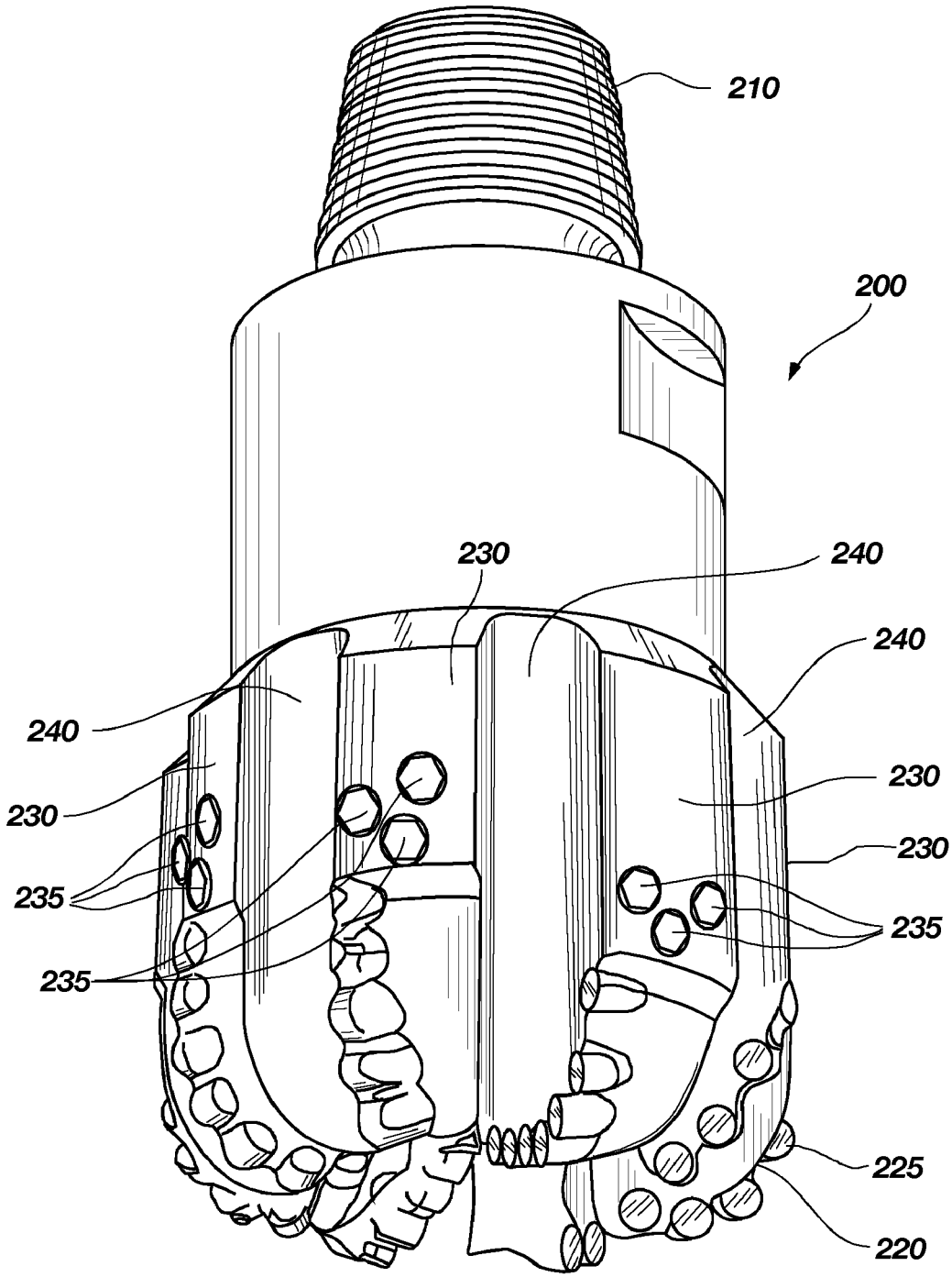
FIG. 2 is a perspective view of a conventional matrix-type rotary drag bit.

FIG. 2 is a perspective view of an exemplary drill bit 200 of a fixed-cutter, or so-called "drag" bit, variety. Conventionally, the drill bit 200 includes threads at a shank 210 at the upper extent of the drill bit 200 for connection into the drillstring 140. At least one blade 220 (a plurality shown) at a generally opposite end from the shank 210 may be provided with a plurality of natural or synthetic diamond (polycrystalline diamond compact) PDC cutters 225, arranged along the rotationally leading faces of the blades 220 to effect efficient disintegration of formation material as the drill bit 200 is rotated in the borehole 100 (FIG. 1) under applied weight on bit (WOB). A gage pad surface 230 extends upwardly from each of the blades 220, is proximal to, and generally contacts the sidewall of the borehole 100 during drilling operation of the drill bit 200. A plurality of channels 240, termed "junkslots," extend between the blades 220 and the gage pad surfaces 230 to provide a clearance area for removal of formation chips formed by the cutters 225.

A plurality of gage inserts 235 is provided on the gage pad surfaces 230 of the drill bit 200. Shear cutting gage inserts 235 on the gage pad surfaces 230 of the drill bit 200 provide the ability to actively shear formation material at the sidewall of the borehole 100 and to provide improved gage-holding ability in earth-boring bits of the fixed cutter variety. The drill bit 200 is illustrated as a PDC (polycrystalline diamond compact) bit, but the gage inserts 235 may be equally useful in other fixed cutter or drag bits that include gage pad surfaces 230 for engagement with the sidewall of the borehole 100.

Those of ordinary skill in the art will recognize that the present invention may be embodied in a variety of drill bit types. The present invention possesses utility in the context of a tricone or roller cone rotary drill bit or other subterranean drilling tools as known in the art that may employ nozzles for delivering drilling mud to a cutting structure during use. Accordingly, as used herein, the term "drill bit" includes and encompasses any and all rotary bits, including core bits, rollercone bits, fixed cutter bits; including PDC, natural diamond, thermally stable produced (TSP) synthetic diamond, and diamond impregnated bits without limitation, eccentric bits, bicenter bits, reamers, reamer wings, as well as other earth-boring tools configured for acceptance of an electronics module 290 (FIG. 3A).

Figure 3A:
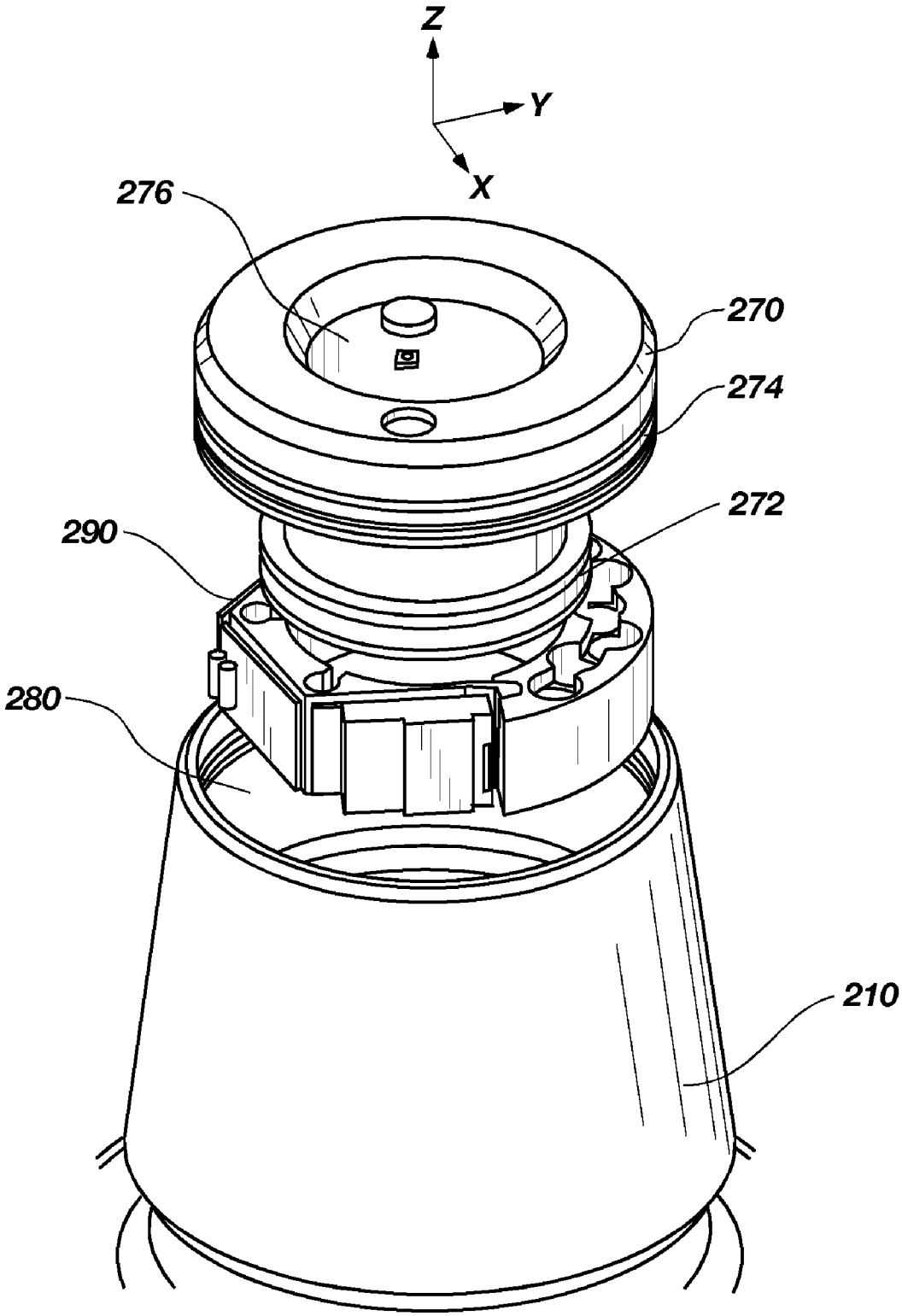
FIG. 3A is a perspective view of a shank, an exemplary electronics module, and an end-cap.
Figure 3B:
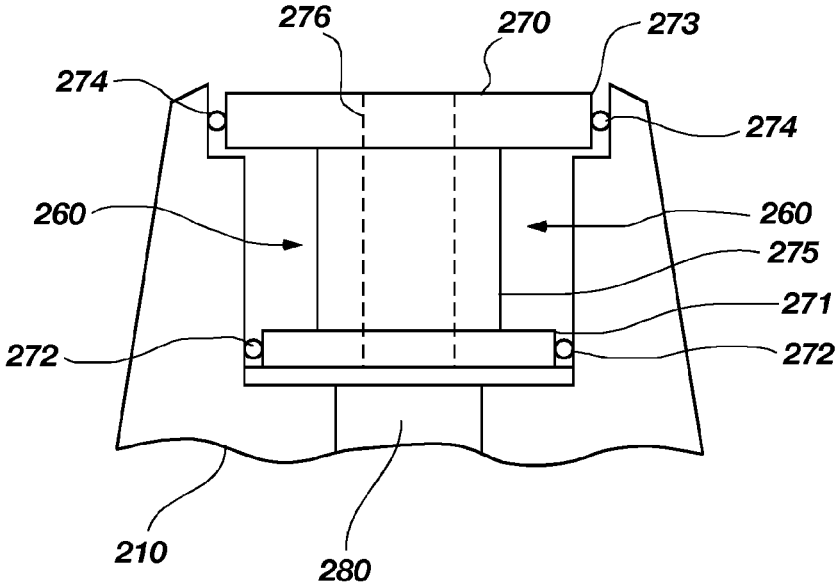
FIG. 3B is a cross-sectional view of a shank and an end-cap.

FIGS. 3A and 3B illustrate an exemplary embodiment of a shank 210 secured to a drill bit 200 (not shown), an end-cap 270, and an exemplary embodiment of an electronics module 290 (not shown in FIG. 3B). The shank 210 includes a central bore 280 formed through the longitudinal axis of the shank 210. In conventional drill bits 200, this central bore 280 is configured for allowing drilling mud to flow therethrough. In the present invention, at least a portion of the central bore 280 is given a diameter sufficient for accepting the electronics module 290 configured in a substantially annular ring, yet without substantially affecting the structural integrity of the shank 210. Thus, the electronics module 290 may be placed down in the central bore 280, about the end-cap 270, which extends through the inside diameter of the annular ring of the electronics module 290 to create a fluid tight annular chamber 260 with the wall of central bore 280 and seal the electronics module 290 in place within the shank 210.

The end-cap 270 includes a cap bore 276 formed therethrough, such that the drilling mud may flow through the end-cap 270, through the central bore 280 of the shank 210 to the other side of the shank 210, and then into the body of drill bit 200. In addition, the end-cap 270 includes a first flange 271 including a first sealing ring 272, near the lower end of the end-cap 270, and a second flange 273 including a second sealing ring 274, near the upper end of the end-cap 270.

FIG. 3B is a cross-sectional view of the end-cap 270 disposed in the shank without the electronics module 290, illustrating the annular chamber 260 formed between the first flange 271, the second flange 273, the end-cap body 275, and the walls of the central bore 280. The first sealing ring 272 and the second sealing ring 274 form a protective, fluid tight, seal between the end-cap 270 and the wall of the central bore 280 to protect the electronics module 290 from adverse environmental conditions. The protective seal formed by the first sealing ring 272 and the second sealing ring 274 may also be configured to maintain the annular chamber 260 at approximately atmospheric pressure.

In the exemplary embodiment shown in FIGS. 3A and 3B, the first sealing ring 272 and the second sealing ring 274 are formed of material suitable for high-pressure, high temperature environment, such as, for example, a Hydrogenated Nitrile Butadiene Rubber (HNBR) O-ring in combination with a PEEK back-up ring. In addition, the end-cap 270 may be secured to the shank 210 with a number of connection mechanisms such as, for example, secure press-fit using sealing rings 272 and 274, a threaded connection, an epoxy connection, a shape-memory retainer welded, and brazed. It will be recognized by those of ordinary skill in the art that the end-cap 270 may be held in place quite firmly by a relatively simple connection mechanism due to differential pressure and downward mud flow during drilling operations.

Figure 4:
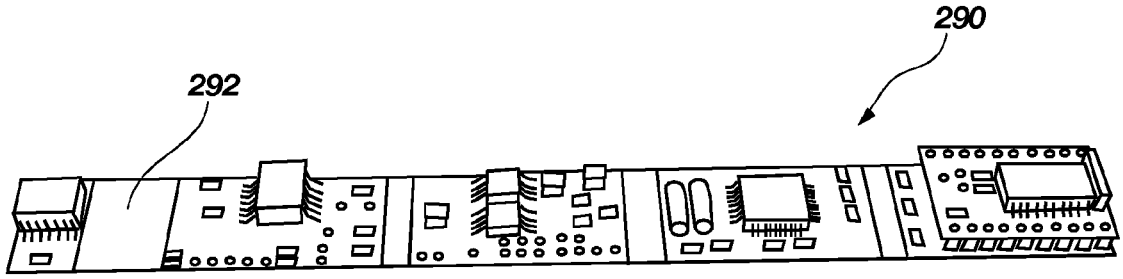
FIG. 4 is a drawing of an embodiment of an exemplary electronics module configured as a flex-circuit board enabling formation into an annular ring suitable for disposition in the shank of FIGS. 3A and 3B.

An electronics module 290 configured as shown in the exemplary embodiment of FIG. 3A may be configured as a flex-circuit board, enabling the formation of the electronics module 290 into the annular ring suitable for disposition about the end-cap 270 and into the central bore 280. This flex-circuit board embodiment of the electronics module 290 is shown in a flat uncurled configuration in FIG. 4. The flex-circuit board 292 includes a high-strength reinforced backbone (not shown) to provide acceptable transmissibility of acceleration effects to sensors such as accelerometers. In addition, other areas of the flex-circuit board 292 bearing non-sensor electronic components may be attached to the end-cap 270 in a manner suitable for at least partially attenuating the acceleration effects experienced by the drill bit 200 during drilling operations using a material such as a visco-elastic adhesive.

Figure 5A:
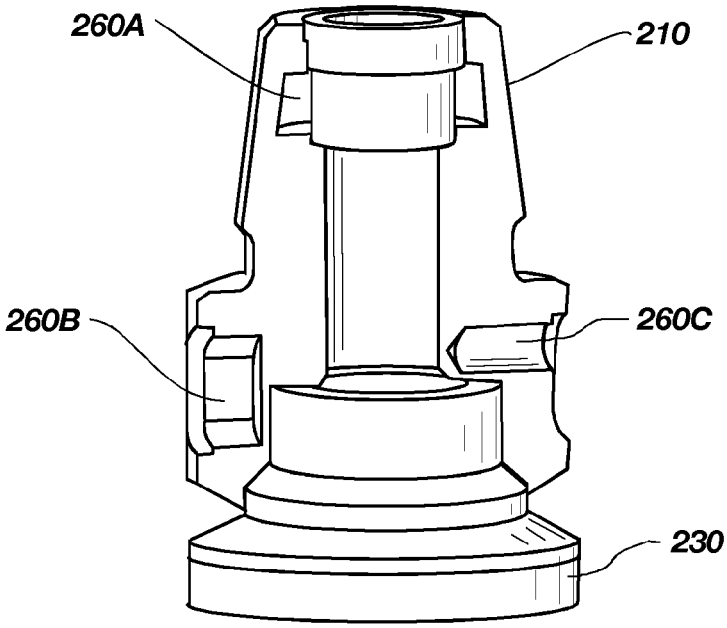
FIGS. 5A-5E are perspective views of a drill bit illustrating exemplary locations in the drill bit wherein an electronics module, sensors, or combinations thereof may be located.

FIGS. 5A-5E are perspective views of a drill bit 200 illustrating exemplary locations in the drill bit 200 wherein an electronics module 290, sensors 340, or combinations thereof may be located. FIG. 5A illustrates the shank 210 of FIG. 3 secured to a bit body 230. In addition, the shank 210 includes an annular race 260A formed in the central bore 280. This annular race 260A may allow expansion of the electronics module 290 into the annular race 260A as the end-cap 270 is disposed into position.

FIG. 5A also illustrates two other alternate locations for the electronics module 290, sensors 340, or combinations thereof. An oval cut out 260B, located behind the oval depression (may also be referred to as a torque slot) used for stamping the bit with a serial number may be milled out to accept the electronics. This area could then be capped and sealed to protect the electronics. Alternatively, a round cut out 260C located in the oval depression used for stamping the bit may be milled out to accept the electronics, then may be capped and sealed to protect the electronics.

Figure 5B:
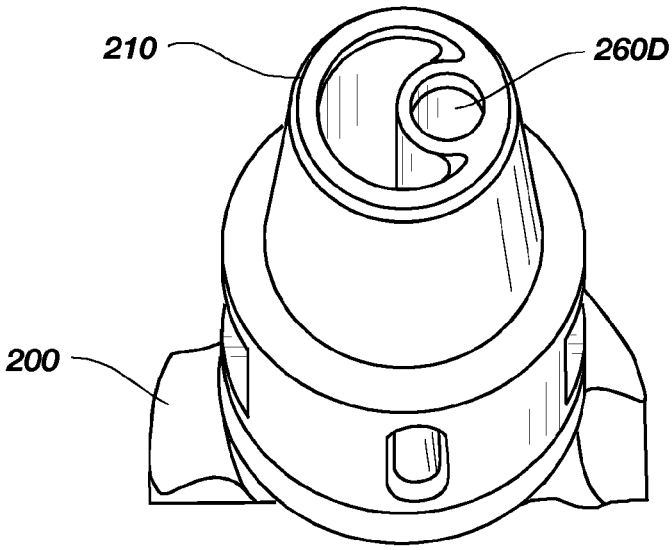

FIG. 5B illustrates an alternate configuration of the shank 210. A circular depression 260D may be formed in the shank 210 and the central bore 280 formed around the circular depression 260D, allowing transmission of the drilling mud. The circular depression 260D may be capped and sealed to protect the electronics within the circular depression 260D.

Figure 5C:
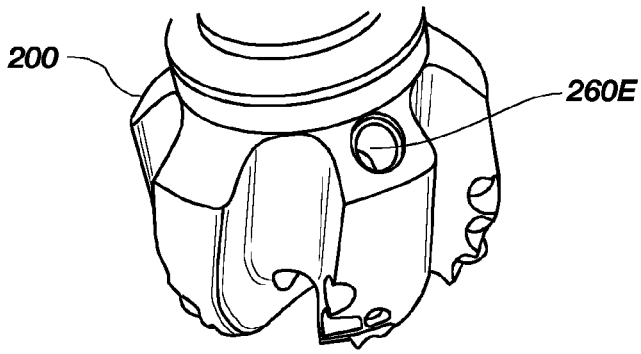
Figure 5D:
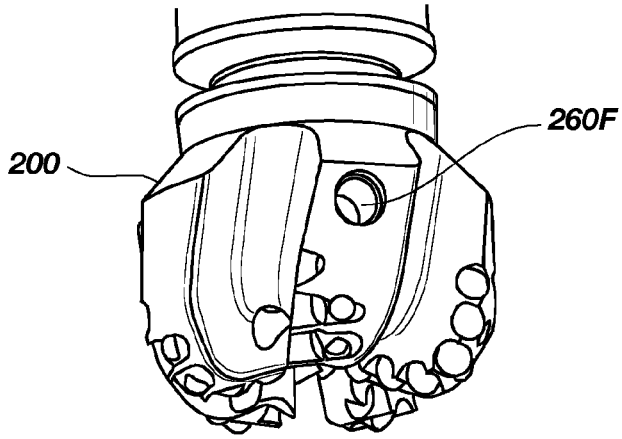
Figure 5E:
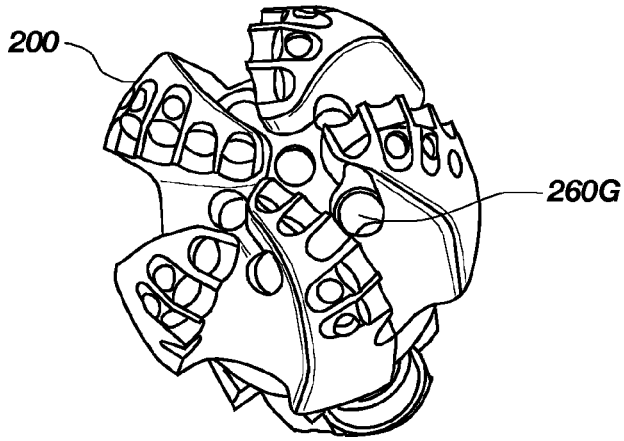

FIGS. 5C-5E illustrate circular depressions (260E, 260F, 260G) formed in locations on the drill bit 200. These locations offer a reasonable amount of room for electronic components while still maintaining acceptable structural strength in the blade.

An electronics module 290 (FIG. 4) may be configured to perform a variety of functions. One exemplary electronics module 290 may be configured as a data analysis module, which is configured for sampling data in different sampling modes, sampling data at different sampling frequencies, and analyzing data.

Figure 6:
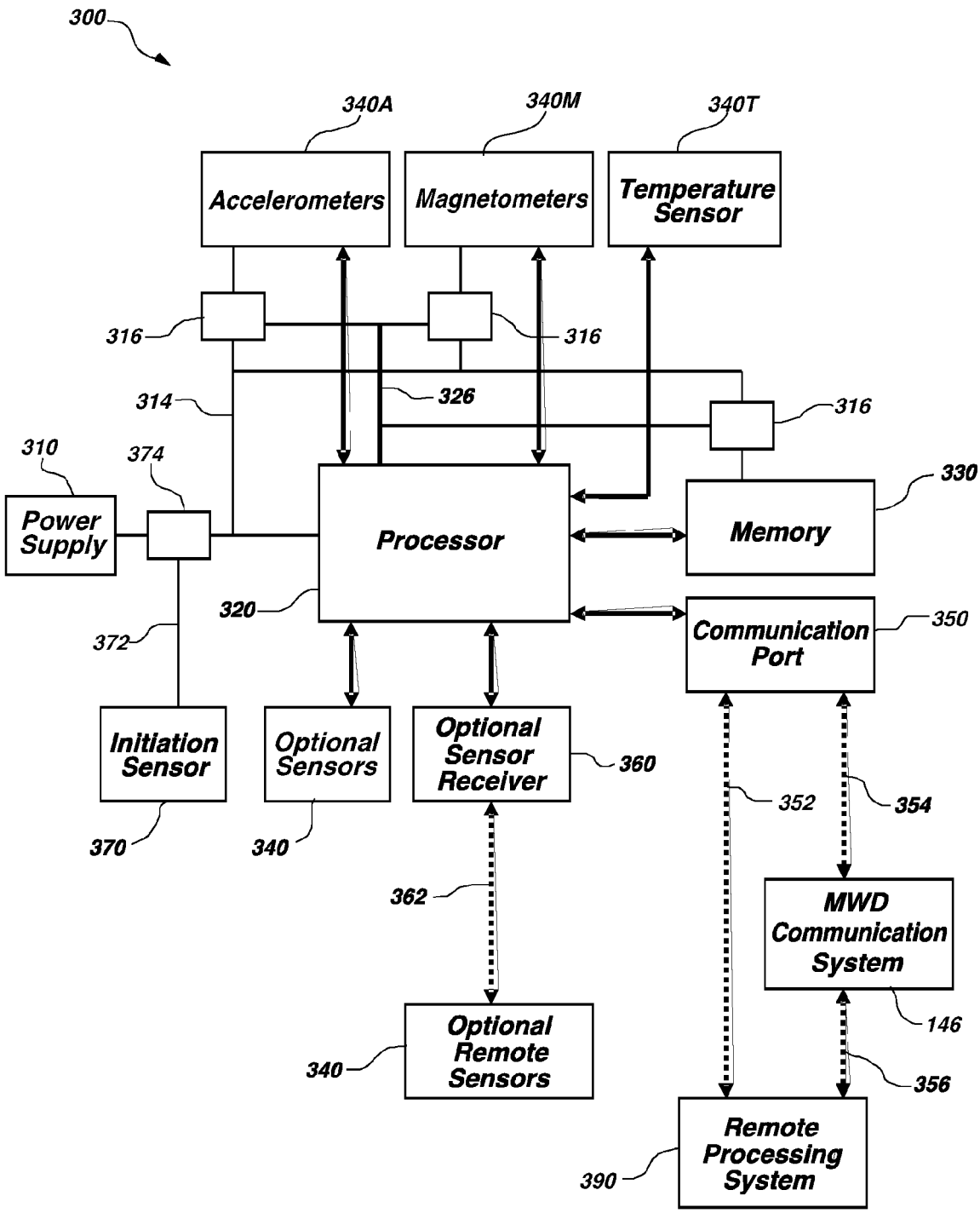
FIG. 6 is a block diagram of an exemplary embodiment of a data analysis module according to the present invention.

An exemplary data analysis module 300 is illustrated in FIG. 6. The data analysis module 300 includes a power supply 310, a processor 320, a memory 330, and at least one sensor 340 configured for measuring a plurality of physical parameters related to a drill bit state, which may include drill bit condition, drilling operation conditions, and environmental conditions proximate the drill bit. In the exemplary embodiment of FIG. 6, the sensors 340 include a plurality of accelerometers 340A, a plurality of magnetometers 340M, and at least one temperature sensor 340T.

The plurality of accelerometers 340A may include three accelerometers 340A configured in a Cartesian coordinate arrangement. Similarly, the plurality of magnetometers 340M may include three magnetometers 340M configured in a Cartesian coordinate arrangement. While any coordinate system may be defined within the scope of the present invention, an exemplary Cartesian coordinate system, shown in FIG. 3A, defines a z-axis along the longitudinal axis about which the drill bit 200 rotates, an x-axis perpendicular to the z-axis, and a y-axis perpendicular to both the z-axis and the x-axis, to form the three orthogonal axes of a typical Cartesian coordinate system. Because the data analysis module 300 may be used while the drill bit 200 is rotating and with the drill bit 200 in other than vertical orientations, the coordinate system may be considered a rotating Cartesian coordinate system with a varying orientation relative to the fixed surface location of the drilling rig 110 (FIG. 1).

The accelerometers 340A of the FIG. 6 embodiment, when enabled and sampled, provide a measure of acceleration of the drill bit 200 along at least one of the three orthogonal axes. The data analysis module 300 may include additional accelerometers 340A to provide a redundant system, wherein various accelerometers 340A may be selected, or deselected, in response to fault diagnostics performed by the processor 320.

The magnetometers 340M of the FIG. 6 embodiment, when enabled and sampled, provide a measure of the orientation of the drill bit 200 along at least one of the three orthogonal axes relative to the earth's magnetic field. The data analysis module 300 may include additional magnetometers 340M to provide a redundant system, wherein various magnetometers 340M may be selected, or deselected, in response to fault diagnostics performed by the processor 320.

The temperature sensor 340T may be used to gather data relating to the temperature of the drill bit 200, and the temperature near the accelerometers 340A, magnetometers 340M, and other sensors 340. Temperature data may be useful for calibrating the accelerometers 340A and magnetometers 340M to be more accurate at a variety of temperatures.

Other optional sensors 340 may be included as part of the data analysis module 300. Some exemplary sensors that may be useful in the present invention are strain sensors at various locations of the drill bit, temperature sensors at various locations of the drill bit, mud (drilling fluid) pressure sensors to measure mud pressure internal to the drill bit, and borehole pressure sensors to measure hydrostatic pressure external to the drill bit. These optional sensors 340 may include sensors 340 that are integrated with and configured as part of the data analysis module 300. These sensors 340 may also include optional remote sensors 340 placed in other areas of the drill bit 200, or above the drill bit 200 in the bottom hole assembly. The optional remote sensors 340 may communicate using a direct-wired connection 362, or through a wireless connection to an optional sensor receiver 360. The sensor receiver 360 is configured to enable wireless remote sensor communication across limited distances in a drilling environment as are known by those of ordinary skill in the art.

One or more of these optional sensors may be used as an initiation sensor 370. The initiation sensor 370 may be configured for detecting at least one initiation parameter, such as, for example, turbidity of the mud, and generating a power enable signal 372 responsive to the at least one initiation parameter. A power gating module 374 coupled between the power supply 310, and the data analysis module 300 may be used to control the application of power to the data analysis module 300 when the power enable signal 372 is asserted. The initiation sensor 370 may have its own independent power source, such as a small battery, for powering the initiation sensor 370 during times when the data analysis module 300 is not powered. As with the other optional remote sensors 340, some exemplary parameter sensors that may be used for enabling power to the data analysis module 300 are sensors configured to sample; strain at various locations of the drill bit, temperature at various locations of the drill bit, vibration, acceleration, centripetal acceleration, fluid pressure internal to the drill bit, fluid pressure external to the drill bit, fluid flow in the drill bit, fluid impedance, and fluid turbidity. In addition, at least some of these sensors may be configured to generate any required power for operation such that the independent power source is self-generated in the sensor. By way of example, and not limitation, a vibration sensor may generate sufficient power to sense the vibration and transmit the power enable signal 372 simply from the mechanical vibration.

The memory 330 may be used for storing sensor data, signal processing results, long-term data storage, and computer instructions for execution by the processor 320. Portions of the memory 330 may be located external to the processor 320 and portions may be located within the processor 320. The memory 330 may be Dynamic Random Access Memory (DRAM), Static Random Access Memory (SRAM), Read Only Memory (ROM), Nonvolatile Random Access Memory (NVRAM), such as Flash memory, Electrically Erasable Programmable ROM (EEPROM), or combinations thereof. In the FIG. 6 exemplary embodiment, the memory 330 is a combination of SRAM in the processor (not shown), Flash memory 330 in the processor 320, and external Flash memory 330. Flash memory may be desirable for low power operation and ability to retain information when no power is applied to the memory 330.

A communication port 350 may be included in the data analysis module 300 for communication to external devices such as the MWD communication system 146 and a remote processing system 390. The communication port 350 may be configured for a direct communication link 352 to the remote processing system 390 using a direct wire connection or a wireless communication protocol, such as, by way of example only, infrared, BLUETOOTH®, and 802.11a/b/g protocols. Using the direct communication, the data analysis module 300 may be configured to communicate with a remote processing system 390 such as, for example, a computer, a portable computer, and a personal digital assistant (PDA) when the drill bit 200 is not downhole. Thus, the direct communication link 352 may be used for a variety of functions, such as, for example, to download software and software upgrades, to enable setup of the data analysis module 300 by downloading configuration data, and to upload sample data and analysis data. The communication port 350 may also be used to query the data analysis module 300 for information related to the drill bit, such as, for example, bit serial number, data analysis module serial number, software version, total elapsed time of bit operation, and other long term drill bit data which may be stored in the NVRAM.

The communication port 350 may also be configured for communication with the MWD communication system 146 in a bottom hole assembly via a wired or wireless communication link 354 and protocol configured to enable remote communication across limited distances in a drilling environment as are known by those of ordinary skill in the art. One available technique for communicating data signals to an adjoining subassembly in the drillstring 140 (FIG. 1) is depicted, described, and claimed in U.S. Pat. No. 4,884,071 entitled "Wellbore Tool With Hall Effect Coupling," which issued on Nov. 28, 1989 to Howard, the disclosure of which is incorporated herein by reference.

The MWD communication system 146 may, in turn, communicate data from the data analysis module 300 to a remote processing system 390 using mud pulse telemetry 356 or other suitable communication means suitable for communication across the relatively large distances encountered in a drilling operation.

The processor 320 in the exemplary embodiment of FIG. 6 is configured for processing, analyzing, and storing collected sensor data. For sampling of the analog signals from the various sensors 340, the processor 320 of this exemplary embodiment includes a digital-to-analog converter (DAC). However, those of ordinary skill in the art will recognize that the present invention may be practiced with one or more external DACs in communication between the sensors 340 and the processor 320. In addition, the processor 320 in the exemplary embodiment includes internal SRAM and NVRAM. However, those of ordinary skill in the art will recognize that the present invention may be practiced with memory 330 that is only external to the processor 320 as well as in a configuration using no external memory 330 and only memory 330 internal to the processor 320.

The exemplary embodiment of FIG. 6 uses battery power as the operational power supply 310. Battery power enables operation without consideration of connection to another power source while in a drilling environment. However, with battery power, power conservation may become a significant consideration in the present invention. As a result, a low power processor 320 and low power memory 330 may enable longer battery life. Similarly, other power conservation techniques may be significant in the present invention.

The exemplary embodiment of FIG. 6, illustrates power controllers 316 for gating the application of power to the memory 330, the accelerometers 340A, and the magnetometers 340M. Using these power controllers 316, software running on the processor 320 may manage a power control bus 326 including control signals for individually enabling a voltage signal 314 to each component connected to the power control bus 326. While the voltage signal 314 is shown in FIG. 6 as a single signal, it will be understood by those of ordinary skill in the art that different components may require different voltages. Thus, the voltage signal 314 may be a bus including the voltages necessary for powering the different components.

Figure 7A:
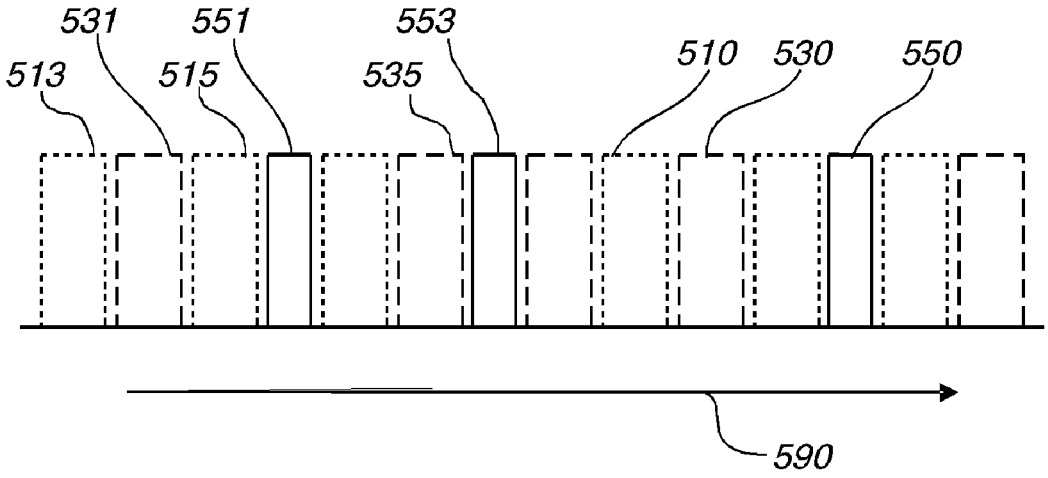
FIG. 7A is an exemplary timing diagram illustrating various data sampling modes and transitions between the modes based on a time based event trigger.
Figure 7B:
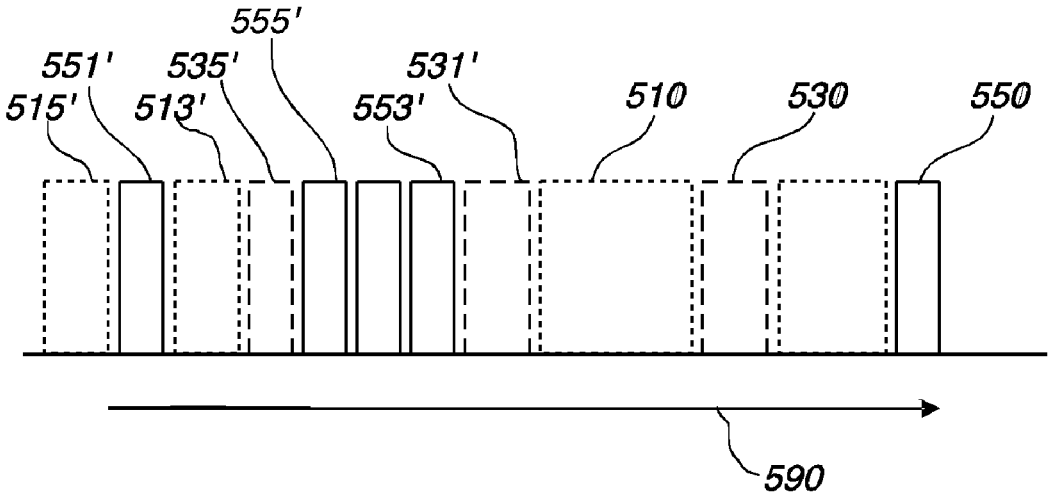
FIG. 7B is an exemplary timing diagram illustrating various data sampling modes and transitions between the modes based on an adaptive threshold based event trigger.

FIGS. 7A and 7B illustrate some exemplary data sampling modes that the data analysis module 300 may perform. The data sampling modes may include a background mode 510, a logging mode 530, and a burst mode 550. The different modes may be characterized by what type of sensor data is sampled and analyzed as well as at what sampling frequency the sensor data is sampled.

The background mode 510 may be used for sampling data at a relatively low background sampling frequency and generating background data from a subset of all the available sensors 340. The logging mode 530 may be used for sampling logging data at a relatively mid-level logging sampling frequency and with a larger subset, or all, of the available sensors 340. The burst mode 550 may be used for sampling burst data at a relatively high burst sampling frequency and with a large subset, or all, of the available sensors 340.

Each of the different data modes may collect, process, and analyze data from a subset of sensors at a predefined sampling frequency and for a predefined block size. By way of example, and not limitation, exemplary sampling frequencies, and block collection sizes may be: 5 samples/sec, and 200 seconds worth of samples per block for background mode, 100 samples/sec, and ten seconds worth of samples per block for logging mode, and 200 samples/sec, and five seconds worth of samples per block for burst mode. Some embodiments of the invention may be constrained by the amount of memory available, the amount of power available or combination thereof.

More memory, more power, or combination thereof may be required for more detailed modes, therefore, the adaptive threshold triggering enables a method of optimizing memory usage, power usage, or combinations thereof relative to collecting and processing the most useful and detailed information. For example, the adaptive threshold triggering may be adapted for detection of specific types of known events, such as, for example, bit whirl, bit bounce, bit wobble, bit walking, lateral vibration, and torsional oscillation.

Generally, the data analysis module 300 may be configured to transition from one mode to another mode based on some type of event trigger. FIG. 7A illustrates a timing triggered mode wherein the transition from one mode to another is based on a timing event, such as, for example, collecting a predefined number of samples, or expiration of a timing counter. The x-axis 590 illustrates advancing time. Timing point 513 illustrates a transition from the background mode 510 to the logging mode 530 due to a timing event. Timing point 531 illustrates a transition from the logging mode 530 to the background mode 510 due to a timing event. Timing point 515 illustrates a transition from the background mode 510 to the burst mode 550 due to a timing event. Timing point 551 illustrates a transition from the burst mode 550 to the background mode 510 due to a timing event. Timing point 535 illustrates a transition from the logging mode 530 to the burst mode 550 due to a timing event Finally, timing point 553 illustrates a transition from the burst mode 550 to the logging mode 530 due to a timing event.

FIG. 7B illustrates an adaptive sampling trigger mode wherein the transition from one mode to another is based on analysis of the collected data to create a severity index and whether the severity index is greater than or less than an adaptive threshold. The adaptive threshold may be a predetermined value, or it may be modified based on signal processing analysis of the past history of collected data. The x-axis 590 illustrates advancing time. Timing point 513' illustrates a transition from the background mode 510 to the logging mode 530 due to an adaptive threshold event. Timing point 531' illustrates a transition from the logging mode 530 to the background mode 510 due to a timing event. Timing point 515' illustrates a transition from the background mode 510 to the burst mode 550 due to an adaptive threshold event. Timing point 551' illustrates a transition from the burst mode 550 to the background mode 510 due to an adaptive threshold event. Timing point 535' illustrates a transition from the logging mode 530 to the burst mode 550 due to an adaptive threshold event. Finally, timing point 553, illustrates a transition from the burst mode 550 to the logging mode 530 due to an adaptive threshold event. In addition, the data analysis module 300 may remain in any given data sampling mode from one sampling block to the next sampling block, if no adaptive threshold event is detected, as illustrated by timing point 555'.

The software, which may also be referred to as firmware, for the data analysis module 300 comprises computer instructions for execution by the processor 320. The software may reside in an external memory 330, or memory within the processor 320. FIGS. 8A-8H illustrate major functions of exemplary embodiments of the software according to the present invention.

Before describing the main routine in detail, a basic function to collect and queue data, which may be performed by the processor and Analog to Digital Converter (ADC) is described. The ADC routine 780, illustrated in FIG. 8A, may operate from a timer in the processor, which may be set to generate an interrupt at a predefined sampling interval. The interval may be repeated to create a sampling interval clock on which to perform data sampling in the ADC routine 780. The ADC routine 780 may collect data form the accelerometers, the magnetometers, the temperature sensors, and any other optional sensors by performing an analog to digital conversion on any sensors that may present measurements as an analog source. Block 802 shows measurements and calculations that may be performed for the various sensors while in the background mode. Block 804 shows measurements and calculations that may be performed for the various sensors while in the log mode. Block 806 shows measurements and calculations that may be performed for the various sensors while in the burst mode. The ADC routine 780 is entered when the timer interrupt occurs. A decision block 782 determines under which data mode the data analysis module is currently operating.

If in the burst mode, samples are collected (794 and 796) for all the accelerometers and all the magnetometers. The sampled data from each accelerometer and each magnetometer is stored in a burst data record. The ADC routine 780 then sets 798 a data ready flag indicating to the main routine that data is ready to process.

If in the background mode 510, samples are collected 784 from all the accelerometers. As the ADC routine 780 collects data from each accelerometer it adds the sampled value to a stored value containing a sum of previous accelerometer measurements to create a running sum of accelerometer measurements for each accelerometer. The ADC routine 780 also adds the square of the sampled value to a stored value containing a sum of previous squared values to create a running sum of squares value for the accelerometer measurements. The ADC routine 780 also increments the background data sample counter to indicate that another background sample has been collected. Optionally, temperature and sum of temperatures may also be collected and calculated.

If in the logging mode, samples are collected (786, 788, and 790) for all the accelerometers, all the magnetometers, and the temperature sensor. The ADC routine 780 collects a sampled value from each accelerometer and each magnetometer and adds the sampled value to a stored value containing a sum of previous accelerometer and magnetometer measurements to create a running sum of accelerometer measurements and a running sum of magnetometer measurements. In addition, the ADC routine 780 compares the current sample for each accelerometer and magnetometer measurement to a stored minimum value for each accelerometer and magnetometer. If the current sample is smaller than the stored minimum, the current sample is saved as the new stored minimum. Thus, the ADC routine 780 keeps the minimum value sampled for all samples collected in the current data block. Similarly, to keep the maximum value sampled for all samples collected in the current data block, the ADC routine 780 compares the current sample for each accelerometer and magnetometer measurement to a stored maximum value for each accelerometer and magnetometer. If the current sample is larger than the stored maximum, the current sample is saved as the new stored maximum. The ADC routine 780 also creates a running sum of temperature values by adding the current sample for the temperature sensor to a stored value of a sum of previous temperature measurements. The ADC routine 780 then sets 792 a data ready flag indicating to the main routine that data is ready to process.

Figure 8A:
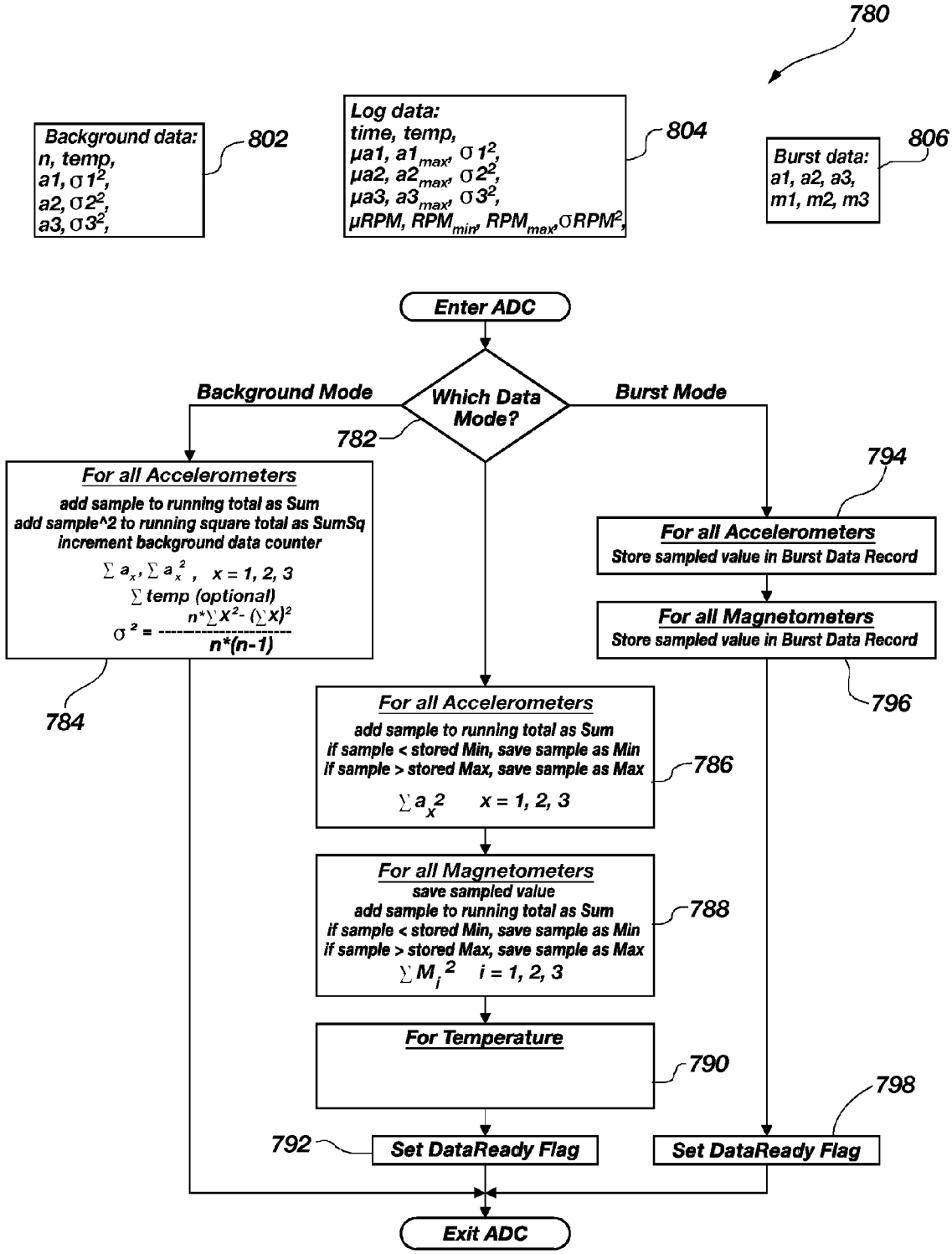
FIGS. 8A-8H are flow diagrams illustrating exemplary operation of the data analysis module in sampling values from various sensors, saving sampled data, and analyzing sampled data to determine adaptive threshold event triggers.
Figure 8B:
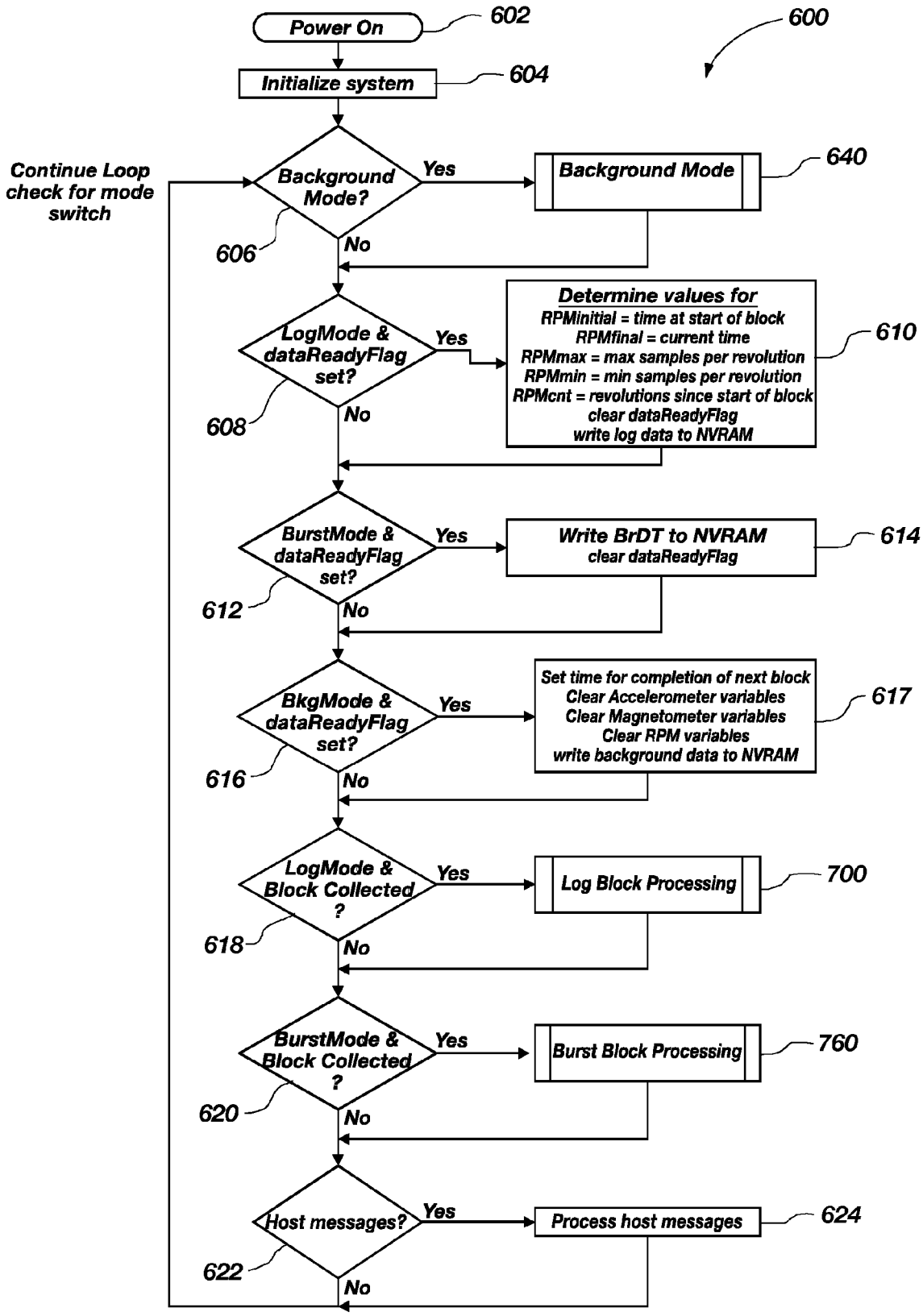

FIG. 8B illustrates major functions of the main routine 600. After power on 602, the main software routine initializes 604 the system by setting up memory, enabling communication ports, enabling the ADC, and generally setting up parameters required to control the data analysis module. The main routine 600 then enters a loop to begin processing collected data. The main routine 600 primarily makes decisions about whether data collected by the ADC routine 780 is available for processing, which data mode is currently active, and whether an entire block of data for the given data mode has been collected. As a result of these decisions, the main routine 600 may perform mode processing for any of the given modes if data is available, but an entire block of data has not yet been processed. On the other hand, if an entire block of data is available, the main routine 600 may perform block processing for any of the given modes.

As illustrated in FIG. 8B, to begin the decision process, a test 606 is performed to see if the operating mode is currently set to background mode. If so, background mode processing 640 begins. If test 606 fails or after background mode processing 640, a test 608 is performed to see if the operating mode is set to logging mode and the data ready flag from the ADC routine 780 is set. If so, logging operations 610 are performed. These operations will be described more fully below. If test 608 fails or after the logging operations 610, a test 612 is performed to see if the operating mode is set to burst mode and the data ready flag from the ADC routine 780 is set. If so, burst operations 614 are performed. These operations will be described more fully below. If test 612 fails or after the burst operations 614, a test 616 is performed to see if the operating mode is set to background mode and an entire block of background data has been collected. If so, background block processing 617 is performed. If test 616 fails or after background block processing 617, a test 618 is performed to see if the operating mode is set to logging mode and an entire block of logging data has been collected. If so, log block processing 700 is performed. If test 618 fails or after log block processing 700, a test 620 is performed to see if the operating mode is set to burst mode and an entire block of burst data has been collected. If so, burst block processing 760 is performed. If test 620 fails or after burst block processing 760, a test 622 is performed to see if there are any host messages to be processed from the communication port. If so, the host messages are processed 624. If test 622 fails or after host messages are processed, the main routine 600 loops back to test 606 to begin another loop of tests to see if any data, and what type of data, may be available for processing. This loop continues indefinitely while the data analysis module is set to a data collection mode.

Details of logging operations 610 are illustrated in FIG. 8B. In this exemplary logging mode, data is analyzed for magnetometers in at least the X and Y directions to determine how fast the drill bit is rotating. In performing this analysis the software maintains variables for a time stamp at the beginning of the logging block (RPMinitial), a time stamp of the current data sample time (RPMfinal), a variable containing the maximum number of time ticks per bit revolution (RPMmax), a variable containing the minimum number of time ticks per bit revolution (RPMmin), and a variable containing the current number of bit revolutions (RPMcnt) since the beginning of the log block. The resulting log data calculated during the ADC routine 780 and during logging operations 610 may be written to nonvolatile RAM.

Magnetometers may be used to determine bit revolutions because the magnetometers are rotating in the Earth's magnetic field. If the bit is positioned vertically, the determination is a relatively simple operation of comparing the history of samples from the X magnetometer and the Y magnetometers. For bits positioned at angle, perhaps due to directional drilling, the calculations may be more involved and require samples from all three magnetometers.

Details of burst operations 614 are also illustrated in FIG. 8B. Burst operations 614 are relatively simple in this exemplary embodiment. The burst data collected by the ADC routine 780 is stored in NVRAM and the data ready flag is cleared to prepare for the next burst sample.

Details of background block processing 617 are also illustrated in FIG. 8B. At the end of a background block, clean up operations are performed to prepare for a new background block. To prepare for a new background block, a completion time is set for the next background block, the variables tracked relating to accelerometers are set to initial values, the variables tracked relating to temperature are set to initial values, the variables tracked relating to magnetometers are set to initial values, and the variables tracked relating to RPM calculations are set to initial values. The resulting background data calculated during the ADC routine 780 and during background block processing 617 may be written to nonvolatile RAM.

In performing adaptive sampling, decisions may be made by the software as to what type of data mode is currently operating and whether to switch to a different data mode based on timing event triggers or adaptive threshold triggers. The adaptive threshold triggers may generally be viewed as a test between a severity index and an adaptive threshold. At least three possible outcomes are possible from this test. As a result of this test, a transition may occur to a more detailed mode of data collection, to a less detailed mode of data collection, or no transition may occur.

These data modes are defined as the background mode 510 being the least detailed, the logging mode 530 being more detailed than the background mode 510, and the burst mode 550 being more detailed than the logging mode 530.

A different severity index may be defined for each data mode. Any given severity index may comprise a sampled value from a sensor, a mathematical combination of a variety of sensors samples, or a signal processing result including historical samples from a variety of sensors. Generally, the severity index gives a measure of particular phenomena of interest. For example, a severity index may be a combination of mean square error calculations for the values sensed by the X accelerometer and the Y accelerometer.

In its simplest form, an adaptive threshold may be defined as a specific threshold (possibly stored as a constant) for which, if the severity index is greater than or less than the adaptive threshold the data analysis module may switch (i.e., adapt sampling) to a new data mode. In more complex forms, an adaptive threshold may change its value (i.e., adapt the threshold value) to a new value based on historical data samples or signal processing analysis of historical data samples.

In general, two adaptive thresholds may be defined for each data mode: a lower adaptive threshold (also referred to as a first threshold) and an upper adaptive threshold (also referred to as a second threshold). Tests of the severity index against the adaptive thresholds may be used to decide if a data mode switch is desirable.

Figure 8C:
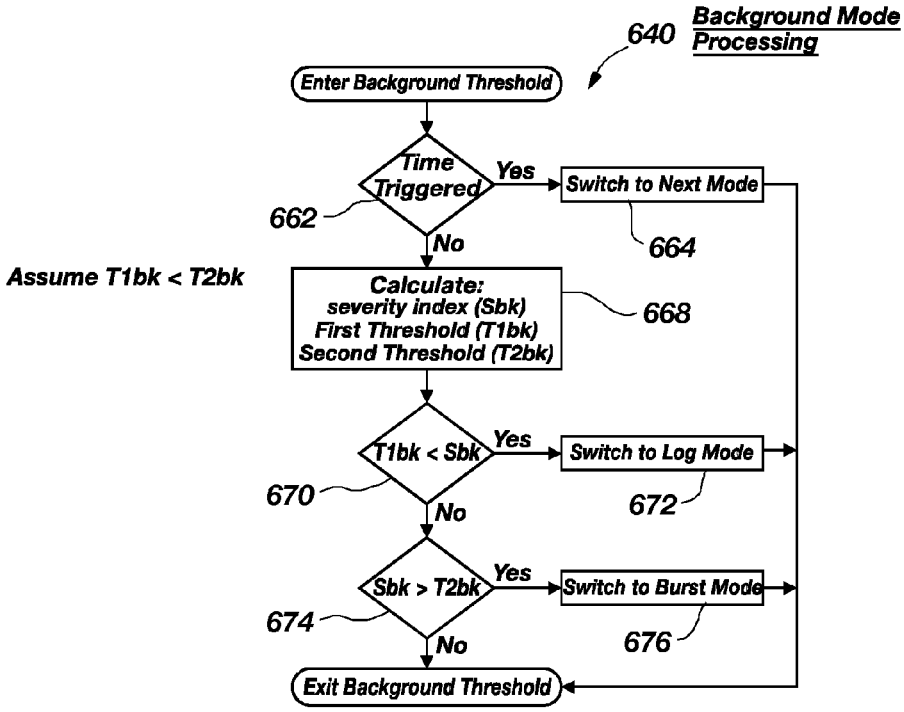
Figure 8D:
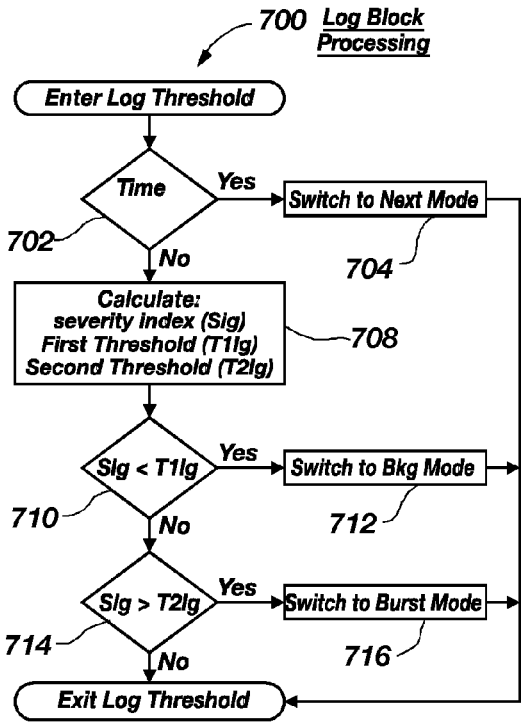
Figure 8E:
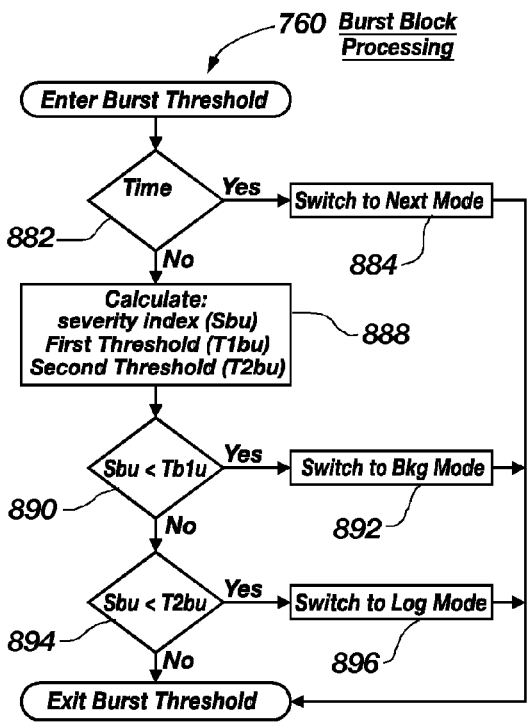

In the computer instructions illustrated in FIGS. 8C-8E, and defining a flexible exemplary embodiment relative to the main routine 600, adaptive threshold decisions are fully illustrated, but details of data processing and data gathering may not be illustrated.

FIG. 8C illustrates general adaptive threshold testing relative to background mode processing 640. First, test 662 is performed to see if a time trigger mode is active. If so, operation block 664 causes the data mode to possibly switch to a different mode. Based on a predetermined algorithm, the data mode may switch to logging mode, burst mode, or may stay in background mode for a predetermined time longer. After switching data modes, the software exits background mode processing.

If test 662 fails, adaptive threshold triggering is active, and operation block 668 calculates a background severity index (Sbk), a first background threshold (T1*bk*), and a second background threshold (T2*bk*). Then, test 670 is performed to see if the background severity index is between the first background threshold and the second background threshold. If so, operation block 672 switches the data mode to logging mode and the software exits background mode processing.

If test 670 fails, test 674 is performed to see if the background severity index is greater than the second background threshold. If so, operation block 676 switches the data mode to burst mode and the software exits background mode processing. If test 674 fails, the data mode remains in background mode and the software exits background mode processing.

FIG. 8D illustrates general adaptive threshold testing relative to log block processing 700. First, test 702 is performed to see if time trigger mode is active. If so, operation block 704 causes the data mode to possibly switch to a different mode. Based on a predetermined algorithm, the data mode may switch to background mode, burst mode, or may stay in logging mode for a predetermined time longer. After switching data modes, the software exits log block processing.

If test 702 fails, adaptive threshold triggering is active, and operation block 708 calculates a logging severity index (Slg), a first logging threshold (T1*lg*), and a second logging threshold (T2*lg*). Then, test 710 is performed to see if the logging severity index is less than the first logging threshold. If so, operation block 712 switches the data mode to background mode and the software exits log block processing.

If test 710 fails, test 714 is performed to see if the logging severity index is greater than the second logging threshold. If so, operation block 716 switches the data mode to burst mode and the software exits log block processing. If test 714 fails, the data mode remains in logging mode and the software exits log block processing.

FIG. 8E illustrates general adaptive threshold testing relative to burst block processing 760. First, test 882 is performed to see if time trigger mode is active. If so, operation block 884 causes the data mode to possibly switch to a different mode. Based on a predetermined algorithm, the data mode may switch to background mode, logging mode, or may stay in burst mode for a predetermined time longer. After switching data modes, the software exits burst block processing.

If test 882 fails, adaptive threshold triggering is active, and operation block 888 calculates a burst severity index (Sbu), a first burst threshold (T1*bu*), and a second burst threshold (T2*bu*). Then, test 890 is performed to see if the burst severity index is less than the first burst threshold. If so, operation block 892 switches the data mode to background mode and the software exits burst block processing.

If test 890 fails, test 894 is performed to see if the burst severity index is less than the second burst threshold. If so, operation block 896 switches the data mode to logging mode and the software exits burst block processing. If test 894 fails, the data mode remains in burst mode and the software exits burst block processing.

Figure 8F:
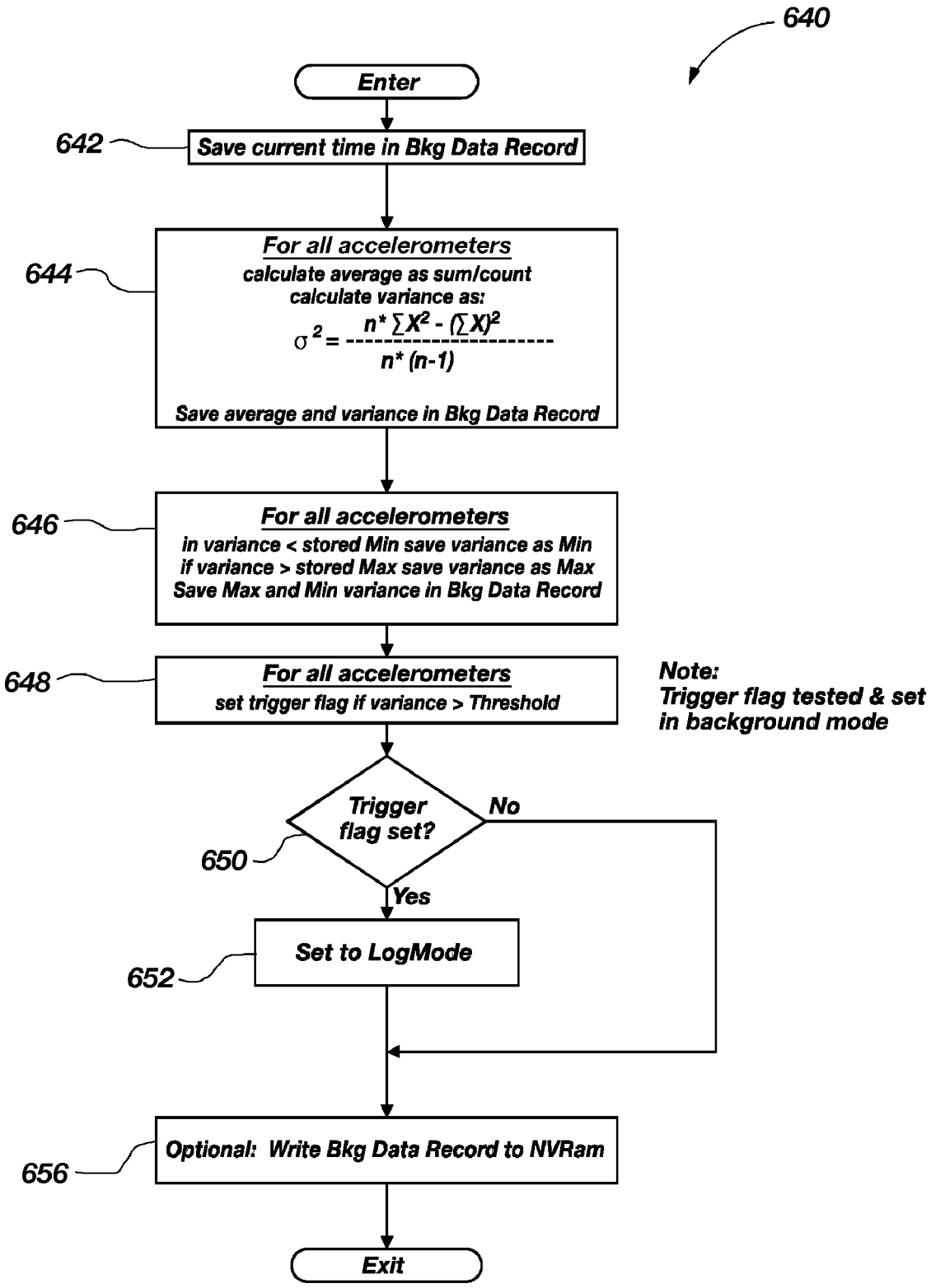
Figure 8G:
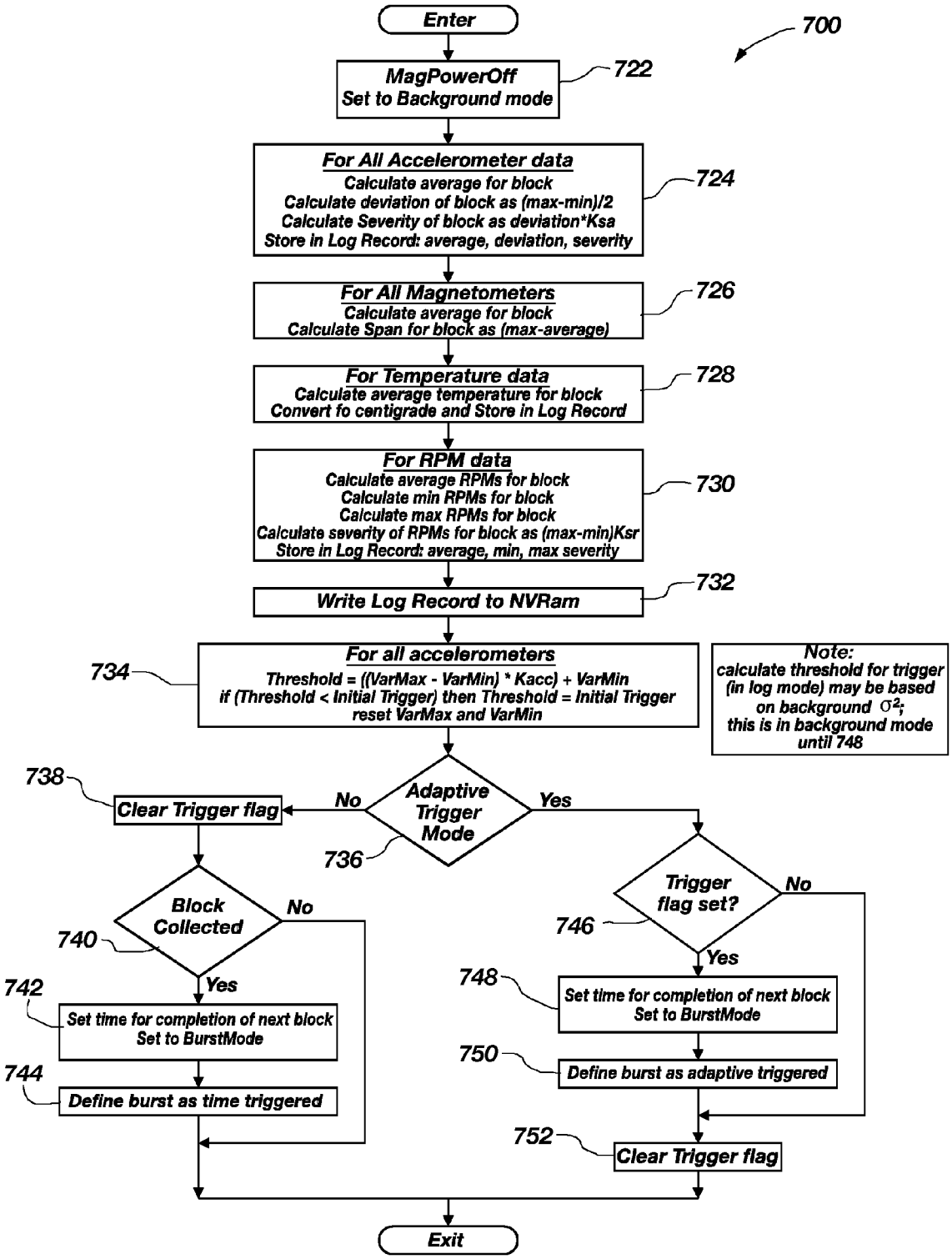
Figure 8H:
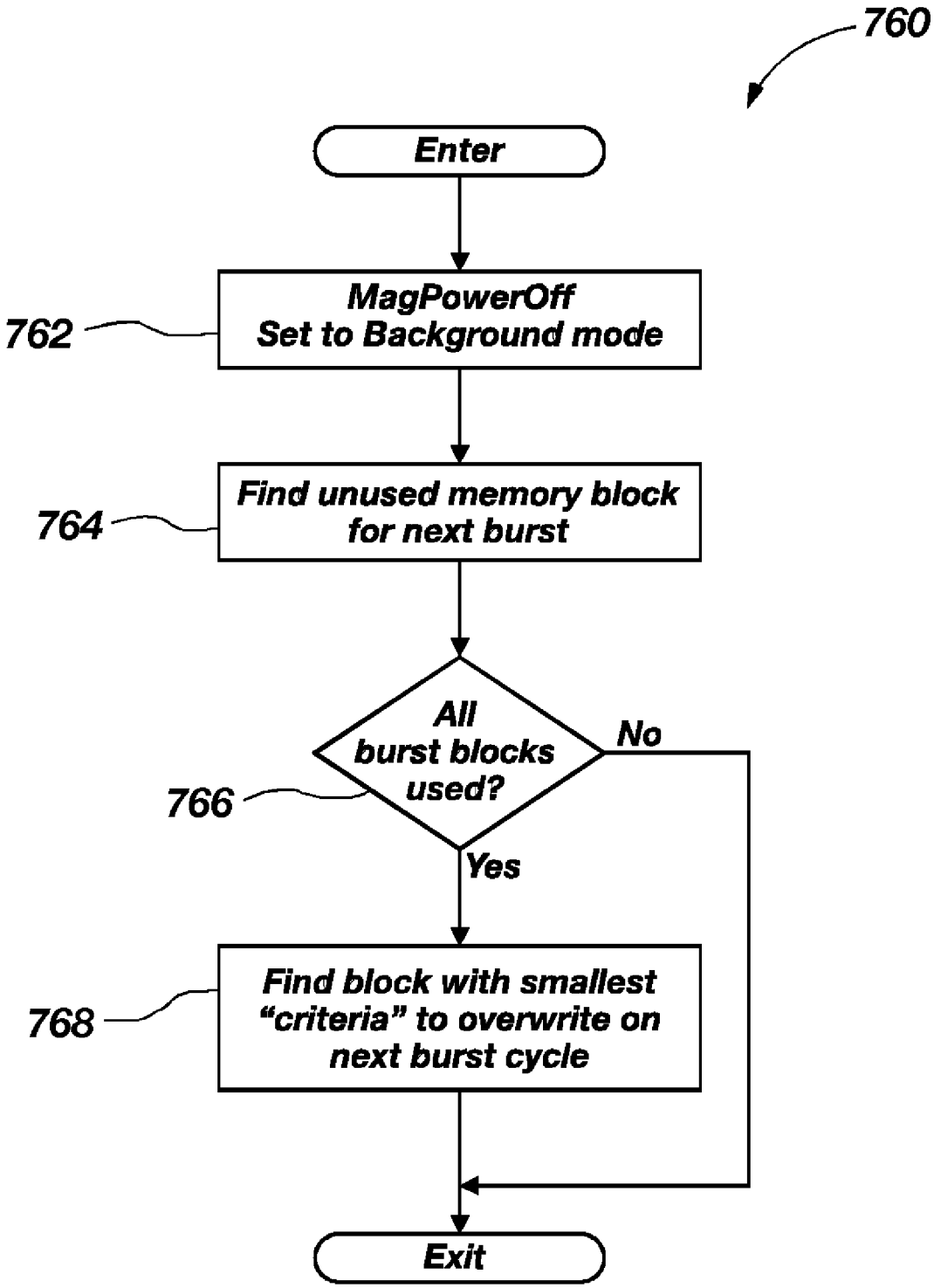

In the computer instructions illustrated in FIGS. 8F-8H, and defining another exemplary embodiment of processing relative to the main routine 600, more details of data gathering and data processing are illustrated, but not all decisions are explained and illustrated. Rather, a variety of decisions are shown to further illustrate the general concept of adaptive threshold triggering.

Details of another embodiment of background mode processing 640 are illustrated in FIG. 5F. In this exemplary background mode, data is collected for accelerometers in the X, Y, and Z directions. The ADC routine 780 stored data as a running sum of all background samples and a running sum of squares of all background data for each of the X, Y, and Z accelerometers. In the background mode processing, the parameters of an average, a variance, a maximum variance, and a minimum variance for each of the accelerometers are calculated and stored in a background data record. First, the software saves 642 the current time stamp in the background data record. Then the parameters are calculated as illustrated in operation blocks 644 and 646. The average may be calculated as the running sum divided by the number of samples currently collected for this block. The variance may be set as a mean square value using the equations as shown in operation block 646. The minimum variance is determined by setting the current variance as the minimum if it is less than any previous value for the minimum variance. Similarly, the maximum variance is determined by setting the current variance as the maximum variance if it is greater than any previous value for the maximum variance. Next, a trigger flag is set 648 if the variance (also referred to as the background severity index) is greater than a background threshold, which in this case is a predetermined value set prior to starting the software. The trigger flag is tested 650. If the trigger flag is not set, the software jumps down to operation block 656. If the trigger flag is set, the software transitions 652 to logging mode. After the switch to logging mode, or if the trigger flag is not set, the software may optionally write 656 the contents of background data record to the NVRAM. In some embodiments, it may not be desirable to use NVRAM space for background data. While in other embodiments, it may be valuable to maintain at least a partial history of data collected while in background mode.

Figure 9:
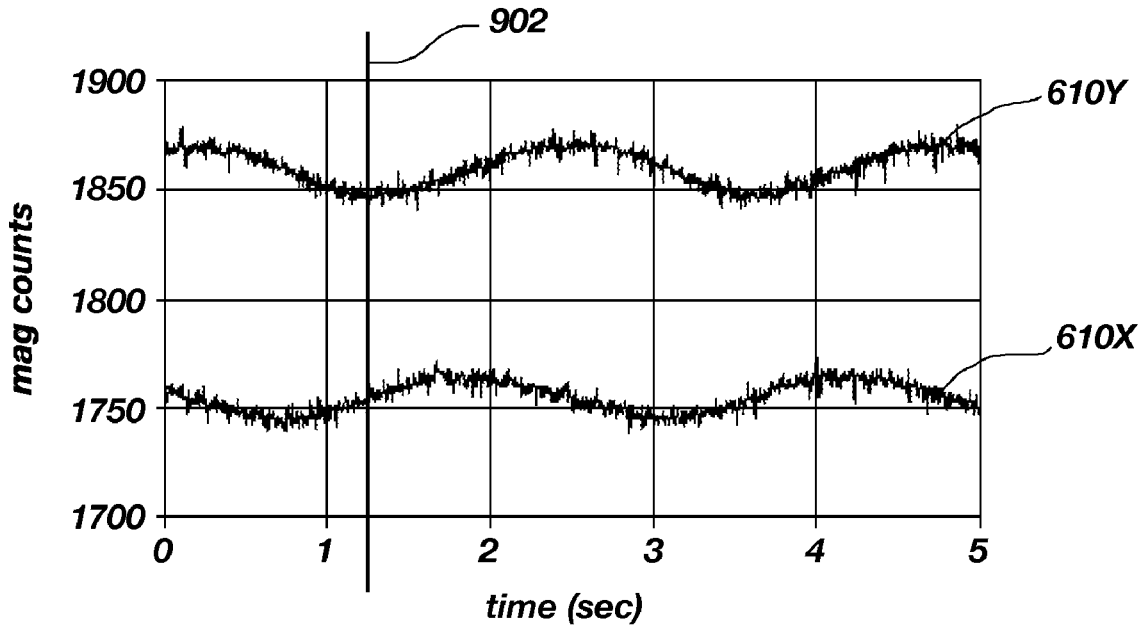
FIG. 9 illustrates exemplary data sampled from magnetometer sensors along two axes of a rotating Cartesian coordinate system.

Referring to FIG. 9, magnetometer samples histories are shown for X magnetometer samples 610X and Y magnetometer samples 610Y. Looking at sample point 902, it can be seen that the Y magnetometer samples are near a minimum and the X magnetometer samples are at a phase of about 90 degrees. By tracking the history of these samples, the software can detect when a complete revolution has occurred. For example, the software can detect when the X magnetometer samples 610X have become positive (i.e., greater than a selected value) as a starting point of a revolution. The software can then detect when the Y magnetometer samples 610Y have become positive (i.e., greater than a selected value) as an indication that revolutions are occurring. Then, the software can detect the next time the X magnetometer samples 610X become positive, indicating a complete revolution. Each time a revolution occurs, the logging operation 610 updates the logging variables described above.

Details of another embodiment of log block processing 700 are illustrated in FIG. 8G. In this exemplary log block processing, the software assumes that the data mode will be reset to the background mode. Thus, power to the magnetometers is shut off and the background mode is set 722. This data mode may be changed later in the log block processing 700 if the background mode is not appropriate. In the log block processing 700, the parameters of an average, a deviation, and a severity for each of the accelerometers are calculated and stored in a log data record. The parameters are calculated as illustrated in operation block 724. The average may be calculated as the running sum prepared by the ADC routine 780 (FIG. 8A) divided by the number of samples currently collected for this block. The deviation is set as one-half of the quantity of the maximum value set by the ADC routine 780 less the minimum value set by the ADC routine 780. The severity is set as the deviation multiplied by a constant (Ksa), which may be set as a configuration parameter prior to software operation. For each magnetometer, the parameters of an average and a span are calculated and stored 726 in the log data record. For the temperature, an average is calculated and stored 728 in the log data record. For the RPM data generated during the log mode processing 610 (in FIG. 8B), the parameters of an average RPM, a minimum RPM, a maximum RPM, and a RPM severity are calculated and stored 730 in the log data record. The severity is set as the maximum RPM minus the minimum RPM multiplied by a constant (Ksr), which may be set as a configuration parameter prior to software operation. After all parameters are calculated, the log data record is stored 732 in NVRAM. For each accelerometer in the system, a threshold value is calculated 734 for use in determining whether an adaptive trigger flag should be set. The threshold value, as defined in block 734, is compared to an initial trigger value. If the threshold value is less than the initial trigger value, the threshold value is set to the initial trigger value.

Once all parameters for storage and adaptive triggering are calculated, a test is performed 736 to determine whether the mode is currently set to adaptive triggering or time based triggering. If the test fails (i.e., time based triggering is active), the trigger flag is cleared 738. A test 740 is performed to verify that data collection is at the end of a logging data block. If not, the software exits the log block processing. If data collection is at the end of a logging data block, burst mode is set 742, and the time for completion of the burst block is set. In addition, the burst block to be captured is defined as time triggered 744.

If the test 736 for adaptive triggering passes, a test 746 is performed to verify that a trigger flag is set, indicating that, based on the adaptive trigger calculations, burst mode should be entered to collect more detailed information. If test 746 passes, burst mode is set 748, and the time for completion of the burst block is set. In addition, the burst block to be captured is defined as adaptive triggered 750. If test 746 fails or after defining the burst block as adaptive triggered, the trigger flag is cleared 752 and log block processing is complete.

Details of another embodiment of burst block processing 760 are illustrated in FIG. 8H. In this exemplary embodiment, a burst severity index is not implemented. Instead, the software always returns to the background mode after completion of a burst block. First, power may be turned off to the magnetometers to conserve power and the software transitions 762 to the background mode.

After many burst blocks have been processed, the amount of memory allocated to storing burst samples may be completely consumed. If this is the case, a previously stored burst block may need to be set to be overwritten by samples from the next burst block. The software checks 764 to see if any unused NVRAM is available for burst block data. If not all burst blocks are used, the software exits the burst block processing. If all burst blocks are used 766, the software uses an algorithm to find 768 a good candidate for overwriting.

It will be recognized and appreciated by those of ordinary skill in the art, that the main routine 600, illustrated in FIG. 8B, switches to adaptive threshold testing after each sample in background mode, but only after a block is collected in logging mode and burst mode. Of course, the adaptive threshold testing may be adapted to be performed after every sample in each mode, or after a full block is collected in each mode. Furthermore, the ADC routine 780, illustrated in FIG. 8A, illustrates an exemplary implementation of data collection and analysis. Many other data collection and analysis operations are contemplated as within the scope of the present invention.

More memory, more power, or combination thereof, may be required for more detailed modes, therefore, the adaptive threshold triggering enables a method of optimizing memory usage, power usage, or combination thereof relative to collecting and processing the most useful and detailed information. For example, the adaptive threshold triggering may be adapted for detection of specific types of known event, such as, for example, bit whirl, bit bounce, bit wobble, bit walking, lateral vibration, and torsional oscillation.

Figure 10:
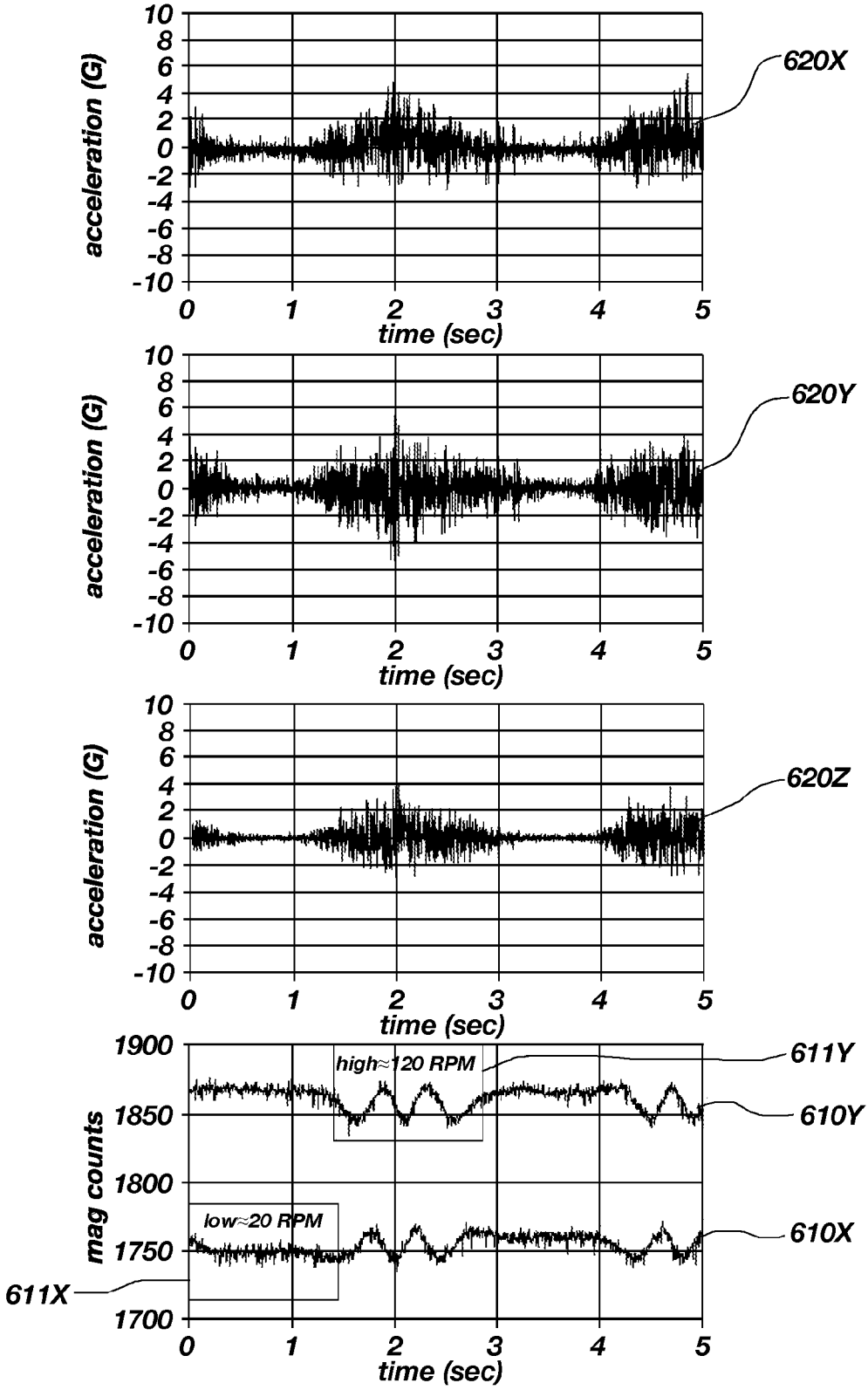
FIG. 10 illustrates exemplary data sampled from accelerometer sensors and magnetometer sensors along three axes of a Cartesian coordinate system that is static with respect to the drill bit, but rotating with respect to a stationary observer.
Figure 11:
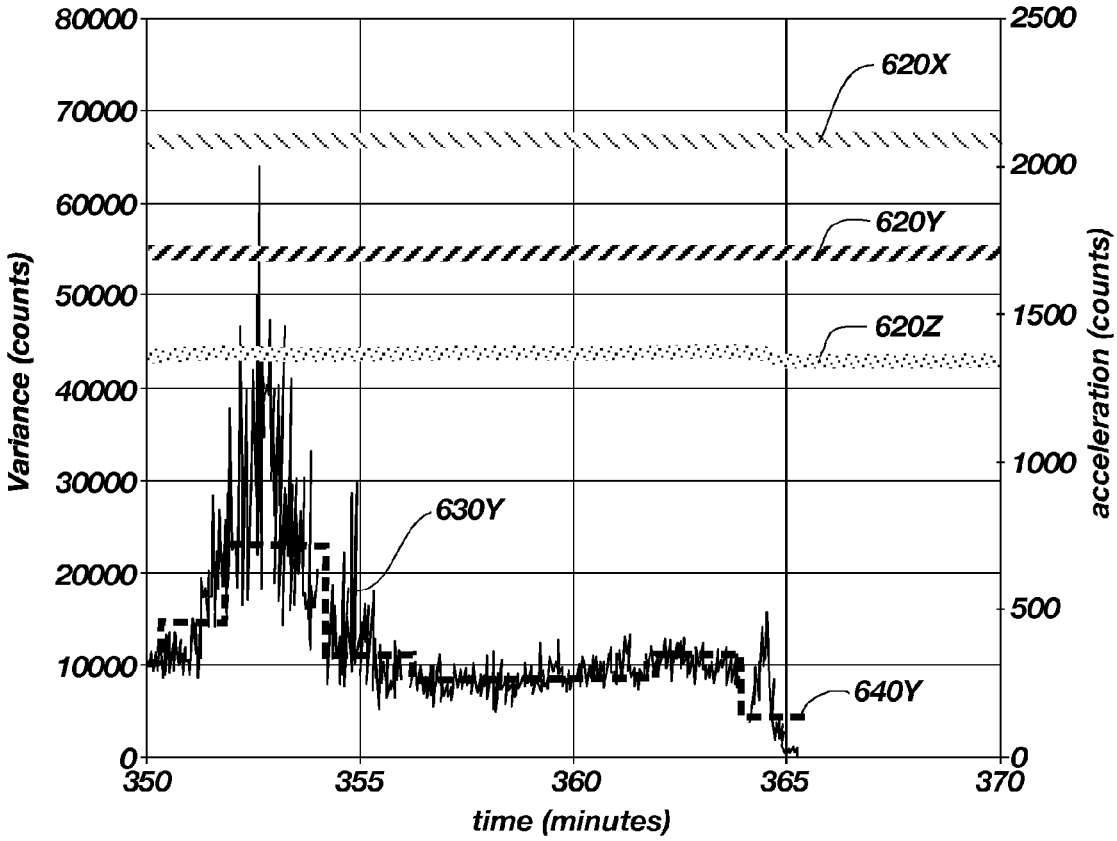
FIG. 11 illustrates exemplary data sampled from accelerometer sensors, accelerometer data variances along a y-axis derived from analysis of the sampled data, and accelerometer adaptive thresholds along the y-axis derived from analysis of the sampled data.
Figure 12:
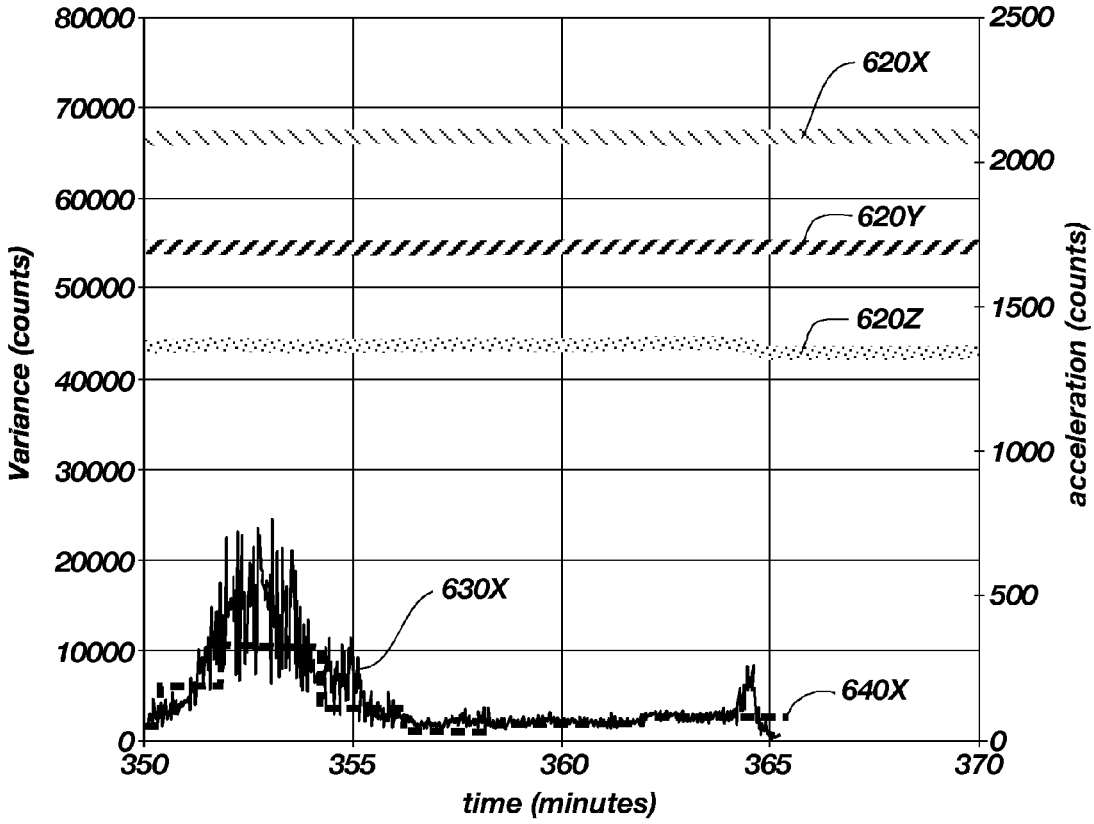
FIG. 12 illustrates exemplary data sampled from accelerometer sensors, accelerometer data variances along an x-axis derived from analysis of the sampled data, and accelerometer adaptive thresholds along the x-axis derived from analysis of the sampled data.

FIGS. 10, 11, and 12 illustrate the exemplary types of data that may be collected by the data analysis module. FIG. 10 illustrates torsional oscillation. Initially, the magnetometer measurements 610Y and 610X illustrate a rotational speed of about 20 revolutions per minute (RPM) 611X, which may be indicative of the drill bit binding on some type of subterranean formation. The magnetometers then illustrate a large increase in rotational speed, to about 120 RPM 611Y, when the drill bit is freed from the binding force. This increase in rotation is also illustrated by the accelerometer measurements 620X, 620Y, and 620Z.

FIG. 11 illustrates waveforms (620X, 620Y, and 620Z) for data collected by the accelerometers. Waveform 630Y illustrates the variance calculated by the software for the Y accelerometer. Waveform 640Y illustrates the threshold value calculated by the software for the Y accelerometer. This Y threshold value may be used, alone or in combination with other threshold values, to determine if a data mode change should occur.

FIG. 12 illustrates waveforms (620X, 620Y, and 620Z) for the same data collected by the accelerometers as is shown in FIG. 11. FIG. 12 also shows waveform 630X, which illustrates the variance calculated by the software for the X accelerometer. Waveform 640X illustrates the threshold value calculated by the software for the X accelerometer. This X threshold value may be used, alone or in combination with other threshold values, to determine if a data mode change should occur.

While the present invention has been described herein with respect to certain preferred embodiments, those of ordinary skill in the art will recognize and appreciate that it is not so limited. Rather, many additions, deletions, and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. A method, comprising:

collecting background data by sampling at least one physical parameter associated with a drill bit state at a background sampling frequency while in a background mode; and transitioning from the background mode to a logging mode after a predetermined number of background samples to sample the at least one physical parameter at a logging sampling frequency higher than the background sampling frequency.

2. The method of claim 1, further comprising storing the background data in memory.

3. The method of claim 1, further comprising:

collecting logging data by sampling the at least one physical parameter at the logging sampling frequency while in the logging mode; and transitioning from the logging mode to the background mode after a predetermined number of logging samples.

4. The method of claim 3, further comprising storing the logging data in memory.

5. The method of claim 1, further comprising:

collecting logging data by sampling the at least one physical parameter at the logging sampling frequency while in the logging mode; and transitioning from the logging mode to a burst mode after a predetermined number of logging samples to sample the at least one physical parameter at a burst sampling frequency higher than the logging sampling frequency.

6. The method of claim 5, further comprising storing the logging data in a memory.

7. The method of claim 5, further comprising:

collecting burst data by sampling the at least one physical parameter at the burst sampling frequency while in the burst mode; and transitioning from the burst mode to the background mode after a predetermined number of burst samples.

8. The method of claim 7, further comprising storing the burst data in a memory.

9. The method of claim 5, further comprising:

collecting burst data by sampling the at least one physical parameter at the burst sampling frequency while in the burst mode; and transitioning from the burst mode to the logging mode, after a predetermined number of burst samples.

10. The method of claim 9, further comprising storing the burst data in memory.

11. A method, comprising:

collecting background data by sampling at least one physical parameter associated with a drill bit state at a background sampling frequency while in a background mode; and transitioning from the background mode to a burst mode after a predetermined number of background samples to sample the at least one physical parameter at a burst sampling frequency higher than the background sampling frequency.

12. The method of claim 11, further comprising storing the background data in memory.

13. The method of claim 11, further comprising:

collecting burst data by sampling the at least one physical parameter at the burst sampling frequency while in the burst mode; and transitioning from the burst mode to the background mode after a predetermined number of burst samples.

14. The method of claim 13, further comprising storing the burst data in memory.

15. The method of claim 11, further comprising:

collecting burst data by sampling the at least one physical parameter at the burst sampling frequency while in the burst mode; and transitioning from the burst mode to a logging mode after a predetermined number of burst samples to sample the at least one physical parameter at a logging sampling frequency lower than the burst sampling frequency.

16. The method of claim 15, further comprising storing the burst data in memory.

17. The method of claim 15, further comprising:

collecting logging data by sampling the at least one physical parameter at the logging sampling frequency while in the logging mode; and transitioning from the logging mode to the background mode after a predetermined number of logging samples.

18. The method of claim 17, further comprising storing the logging data in memory.

19. The method of claim 15, further comprising:

collecting logging data by sampling the at least one physical parameter at the logging sampling frequency while in the logging mode; and transitioning from the logging mode to the burst mode after a predetermined number of logging samples.

20. The method of claim 19, further comprising storing the logging data in memory.

* * * * *

UNITED STATES PATENT AND TRADEMARK OFFICE

CERTIFICATE OF CORRECTION

PATENT NO. : 7,510,026 B2
APPLICATION NO. : 11/939389
DATED : March 31, 2009
INVENTOR(S) : Paul E. Pastusek et al.

It is certified that error appears in the above-identified patent and that said Letters Patent is hereby corrected as shown below:

In the specification:

| | | |
|---|---|---|
| COLUMN 1, | LINE 9, | change "pending." to --now U.S. Pat. No. 7,604,072, issued October 20, 2009.-- |
| COLUMN 11, | LINE 11, | change "**553**," to --**553'**,-- |
| COLUMN 15, | LINE 67, | change "samples" to --samples **610Y**-- |
| COLUMN 16, | LINE 1, | change "samples" to --samples **610X**-- |

Signed and Sealed this
Twentieth Day of September, 2011

David J. Kappos

David J. Kappos
*Director of the United States Patent and Trademark Office*